US010464580B2

(12) United States Patent
Schmidt et al.

(10) Patent No.: US 10,464,580 B2
(45) **Date of Patent: *Nov. 5, 2019**

(54) RAILROAD TANK CAR MANWAY ASSEMBLY

(71) Applicant: Union Tank Car Company, Chicago, IL (US)

(72) Inventors: Dan Schmidt, Chicago, IL (US); Gary C. Walter, Chicago, IL (US); Spencer Johnson, Chicago, IL (US)

(73) Assignee: Union Tank Car Company, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/042,435

(22) Filed: Jul. 23, 2018

(65) Prior Publication Data

US 2018/0327001 A1 Nov. 15, 2018

Related U.S. Application Data

(63) Continuation of application No. 15/685,258, filed on Aug. 24, 2017, now Pat. No. 10,029,705, which is a (Continued)

(51) Int. Cl.
*B65D 90/00* (2006.01)

(52) U.S. Cl.
CPC ..... *B61D 5/08* (2013.01)

(58) Field of Classification Search
CPC ..... B61D 5/08; B61D 39/00; B61D 17/16; F17C 1/00; F17C 137/6877; B65D 90/00; B65D 90/10; B65D 90/34
See application file for complete search history.

(56) References Cited

U.S. PATENT DOCUMENTS 4,248,160 A * 2/1981 Carney, Jr. ..... F16J 13/20 105/377.11
5,394,650 A * 3/1995 Dean ..... B65D 90/10 16/308

(Continued)

FOREIGN PATENT DOCUMENTS

CA 2783037 A1 1/2013
CN 201105888 Y 8/2008

*Primary Examiner* — Jason C Smith

(74) *Attorney, Agent, or Firm* — Banner & Witcoff, Ltd.

(57) ABSTRACT

A manway assembly for a railroad tank car features a nozzle defining a central opening and having a sidewall, a cover, a hinge attaching the cover to the nozzle, and a seal assembly to seal the cover to the nozzle. The seal assembly may include a circumferential seal and a circumferential seal channel. The circumferential seal may include a top portion, a bottom portion opposite the top portion, and a side portion between the top portion and the bottom portion. An underside edge portion of the cover may be provided with the circumferential seal channel. The circumferential seal may be positioned within the circumferential seal channel. The circumferential seal may have a C-shaped cross section and may be positioned in the circumferential seal channel such that the top portion of the seal is seated against a top wall of the circumferential seal channel and the bottom portion of the seal is seated against a circumferential ledge of the nozzle.

18 Claims, 27 Drawing Sheets

Related U.S. Application Data continuation-in-part of application No. 15/353,491, filed on Nov. 16, 2016, now abandoned, which is a continuation of application No. 15/017,287, filed on Feb. 5, 2016, now Pat. No. 9,499,178, which is a continuation of application No. 14/553,610, filed on Nov. 25, 2014, now Pat. No. 9,260,118, which is a continuation-in-part of application No. 13/543,995, filed on Jul. 9, 2012, now Pat. No. 8,899,161.

(60) Provisional application No. 61/505,828, filed on Jul. 8, 2011.

(56) References Cited

U.S. PATENT DOCUMENTS 5,738,396 A * 4/1998 Oestermeyer ..... B61D 17/16 105/377.11
5,967,358 A * 10/1999 Adams ..... B65D 90/10 105/377.05
6,076,471 A * 6/2000 Burian ..... B61D 17/16 105/358
6,595,716 B1 * 7/2003 VanDeVyvere ..... B65D 90/10 404/26
7,131,455 B2 * 11/2006 Horban ..... F17C 1/00 137/350
7,661,371 B2 2/2010 Wyler
8,608,021 B2 * 12/2013 Poulter ..... B60P 3/226 105/358
2007/0235463 A1 * 10/2007 Wyler ..... B60P 3/226 220/835
2009/0158959 A1 * 6/2009 Schultz ..... B61D 17/16 105/377.07
2010/0107926 A1 * 5/2010 Drager ..... F16J 13/18 105/377.07
2012/0031921 A1 * 2/2012 Cadiente ..... B65D 43/162 220/835
2013/0008340 A1 * 1/2013 Douglas ..... B61D 5/08 105/377.07
2015/0083022 A1 * 3/2015 Douglas ..... B61D 5/08 105/377.07
2017/0349188 A1 * 12/2017 Schmidt ..... B61D 5/08

* cited by examiner

RAILROAD TANK CAR MANWAY ASSEMBLY

CROSS REFERENCE TO RELATED APPLICATIONS

This application is a continuation of U.S. patent application Ser. No. 15/685,258, filed Aug. 24, 2017, which is a continuation-in-part of U.S. patent application Ser. No. 15/353,491, filed Nov. 16, 2016, which is a continuation of U.S. patent application Ser. No. 15/017,287, filed Feb. 5, 2016, and issued as U.S. Pat. No. 9,499,178 on Nov. 22, 2016, which is a continuation of U.S. patent application Ser. No. 14/553,610, filed Nov. 25, 2014, and issued as U.S. Pat. No. 9,260,118 on Feb. 16, 2016, which is a continuation-in-part of U.S. patent application Ser. No. 13/543,995, filed Jul. 9, 2012, and issued as U.S. Pat. No. 8,899,161 on Dec. 2, 2014, which claims benefit of priority from U.S. Provisional Patent Application No. 61/505,828, filed Jul. 8, 2011. The entirety of all the above-listed applications are hereby incorporated herein by reference.

FIELD OF THE INVENTION

The present invention generally relates to railroad tank cars and, more particularly, to a manway assembly for a railroad tank car.

BACKGROUND

Railroad tank cars are well known and useful for carrying liquid commodities. A typical general purpose, non-pressurized railroad tank car is indicated in general at 22 in FIGS. 1 and 2. The tank car features a tank body 24 mounted on a pair of wheel trucks 26*a* and 26*b*.

As illustrated in FIGS. 1 and 2, a manway cover 28 is positioned on top of a nozzle 30 which is mounted on the tank body 24. As is known in the art, the manway cover pivots open and may be accessed by a ladder 32. The manway cover permits access to the interior of the tank body 24. Manway covers are typically designed to fit a 20" inner diameter manway nozzle. Nozzles having other inner diameters, however, have been made. These include nozzles having 24", 21", 18-112" and 18" inner diameters.

A prior art manway cover and nozzle is illustrated in FIGS. 3 and 4. The manway cover is secured in the closed configuration on the nozzle by fasteners (eyebolts) that are spaced about the circumference of the manway cover. The typical quantity of eyebolts is either 6 (as illustrated in FIGS. 3 and 4) or 8, however, the industry does have, on rare occasions, 10 bolt arrangements. The eyebolt nuts are individually loosened or tightened in a star pattern with a wrench or similar tool when the manway cover is opened or closed, respectively.

The manway cover features a hinge that permits it to be pivoted from the closed configuration, illustrated in FIGS. 3 and 4, to an open configuration via the handle so that access to the manway is permitted. The manway cover of FIGS. 3 and 4 is equipped with a torsion spring arrangement (Labeled "UTC E-Z Lift" in FIG. 4) at the hinge that aids in the lifting of the cover while opening. The two eyebolts nearest the handle act as safety bolts in that they secure the cover in place while allowing pressure to be relieved in a safe manner. The cover must be slightly opened before the safety eyebolts may be disengaged so that the cover may be pivoted open completely.

All manway cover designs must be approved by the Association of American Railroad Tank Car Committee (AAR/TCC).

Manways are used for several purposes including dome loading or unloading, entry into the tank car, venting (by opening the manway cover), access to view gauging level and commodity sampling. The primary use of the manway at the loading rack is to open for dome loading, while the primary use at the unloading rack is for venting.

Issues with current manway nozzle and cover designs include out of round nozzles, out of flat nozzle and gasket grooves, loose hinge movements that cause interference with fit ups between the manway nozzle and cover, inconsistent sealing, difficulty of assembly and disassembly and loose eyebolts.

Prior art manway covers have been identified as a location where non-accidental leaks consistently occur. Indeed, as illustrated by the graphs of FIGS. 5 and 6, manway covers are the largest contributor to non-accidental releases (NARs) for non-pressurized cars in transit.

In view of the above, it is desirable for manway nozzle and cover designs to feature a round nozzle and a seating surface that is flat. In addition, one input from the operator to secure the manway fasteners is desirable over the 6 to 10 individual inputs required by prior art designs. A repeatable placement of the cover and clamping force on the gasket is also preferable.

BRIEF SUMMARY

The following presents a simplified summary of the invention in order to provide a basic understanding of some aspects of the disclosure. This summary is not an extensive overview of the invention. It is not intended to identify key or critical elements of the invention or to delineate the scope of the invention. The following summary merely presents some concepts of the invention in a simplified form as a prelude to the more detailed description provided below.

A first aspect of the disclosure provides a manway assembly for a railroad tank car, the manway assembly comprising a nozzle defining a central opening and having a sidewall; a cover; a hinge attaching the cover to the nozzle; and a seal assembly to seal the cover with the nozzle. The hinge may attach to cover to the nozzle so that the manway cover is pivoted between an open position, where the central opening is generally uncovered, and a closed position, where the central opening is generally covered by the cover. The seal assembly may seal the cover with the nozzle. The seal assembly may include a circumferential seal and a circumferential seal channel. The circumferential seal may include a top portion, a bottom portion opposite the top portion, and a side portion between the top portion and the bottom portion. An underside edge portion of the cover may be provided with the circumferential seal channel and the circumferential seal is positioned within the circumferential seal channel. The circumferential seal may have a C-shaped cross section. The circumferential seal may be positioned in the circumferential seal channel such that the top portion of the seal is seated against a top wall of the circumferential seal channel and the bottom portion of the seal is seated against a circumferential ledge of the nozzle.

Another aspect of the disclosure provides a manway assembly for a railroad tank car, the manway assembly comprising: a nozzle, a cover, a hinge attaching the cover to the nozzle, and a seal assembly to seal the cover with the nozzle. The nozzle may define a central opening and have a sidewall and a circumferential ledge on the sidewall of the nozzle. The cover may define a circumferential stop portion that provides a metal-to-metal contact with the circumferential ledge when the cover is in a closed position on the nozzle. The hinge may attach to the cover to the nozzle so that said manway cover is pivoted between an open position, where the central opening is generally uncovered, and the closed position, where the central opening is generally covered by the cover. The seal assembly may include a circumferential seal and a circumferential seal channel. The circumferential seal may include a top portion, a bottom portion opposite the top portion, and a side portion between the top portion and the bottom portion. The circumferential seal channel may include a front wall, a back wall opposite the front wall, and a top wall to form the seal channel. An underside edge portion of the cover may be provided with the circumferential seal channel and the circumferential seal may be positioned within the circumferential seal channel. The circumferential seal may have a C-shaped cross section and may be positioned in the circumferential seal channel such that the top portion of the seal is seated against the top wall of the circumferential seal channel, the bottom portion of the seal is seated against the circumferential ledge of the nozzle, and the side portion of the seal is seated against the back wall of the circumferential seal channel.

Another aspect of the disclosure provides a manway assembly for a railroad tank car, the manway assembly comprising: a nozzle, a cover, a hinge attaching the cover to the nozzle, a latch mechanism to secure the cover to the nozzle; and a seal assembly to seal the cover with the nozzle. The nozzle may define a central opening and may have a sidewall and a circumferential ledge on the sidewall of the nozzle. A cover may define an underside edge portion with a circumferential stop portion and a circumferential seal channel, wherein the circumferential stop portion provides a metal-to-metal contact with the circumferential ledge when the cover is in a closed position on the nozzle. The hinge may attach the cover to the nozzle so that said manway cover is pivoted between an open position, where the central opening is generally uncovered, and the closed position, where the central opening is generally covered by the cover. The seal assembly may include a circumferential seal and a circumferential seal channel. The circumferential seal may include a top portion, a bottom portion opposite the top portion, and a side portion between the top portion and the bottom portion. The circumferential seal channel may include a front wall, a back wall opposite the front wall, and a top wall to form the seal channel. An underside edge portion of the cover may be provided with the circumferential seal channel. The circumferential seal may be positioned within the circumferential seal channel. The circumferential seal may have a C-shaped cross section and may be positioned in the circumferential seal channel such that the top portion of the seal is seated against the top wall of the circumferential seal channel, the bottom portion of the seal is seated against the circumferential ledge of the nozzle, and the side portion of the seal is seated against the back wall of the circumferential seal channel. An internal pressure of the railroad tank car presses the circumferential seal against the circumferential seal channel and the circumferential ledge of the nozzle.

The details of these and other embodiments of the present disclosure are set forth in the accompanying drawings and the description below. Other features and advantages of the disclosure will be apparent form the description and drawings.

BRIEF DESCRIPTION OF THE DRAWINGS

A more complete understanding of the present invention and the advantages thereof may be acquired by referring to the following description in consideration of the accompanying drawings, in which like reference numbers indicate like features, and wherein.

DETAILED DESCRIPTION OF EMBODIMENTS

Figure 2:
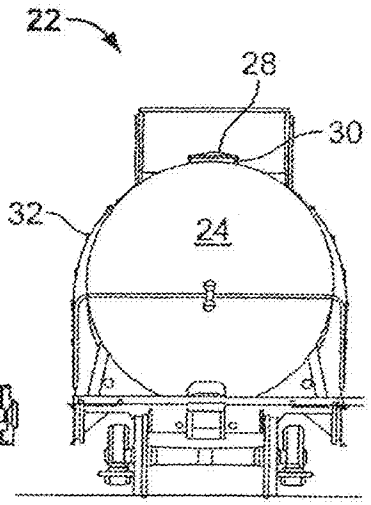
FIG. 2 is an enlarged perspective view of the railroad tank car of FIG. 1.
Figure 1:
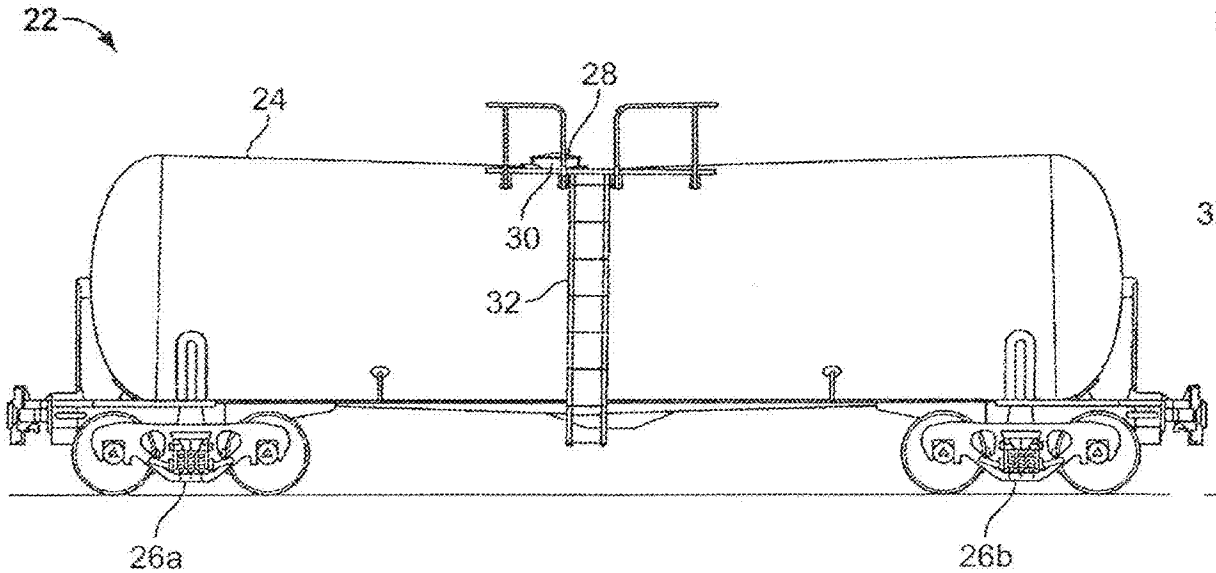
FIG. 1 is a side elevational view of a railroad tank car equipped with a nozzle and manway cover.
Figure 4:
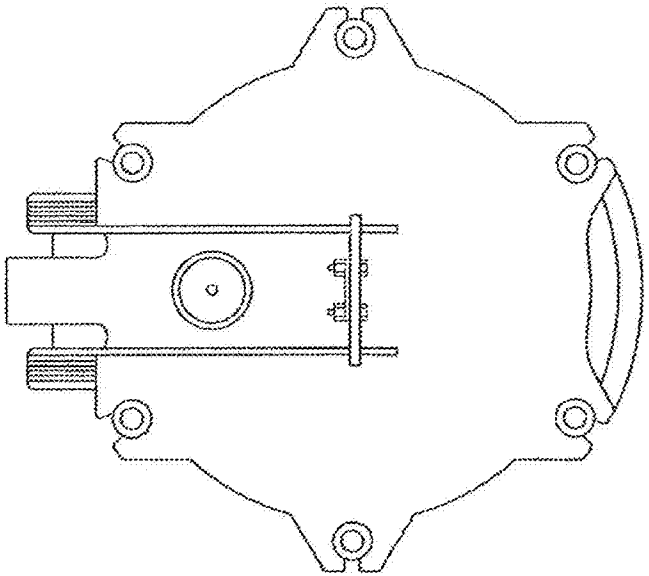
FIG. 4 is a top plan and side elevation view of the manway cover of FIG. 3.
Figure 4:
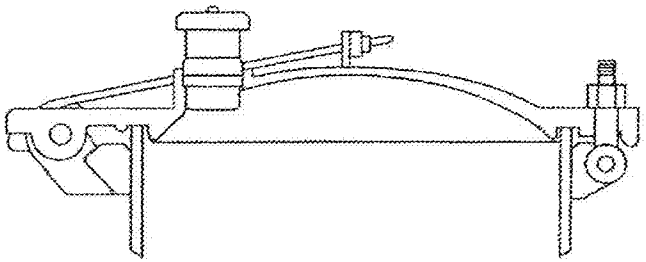
Figure 3:
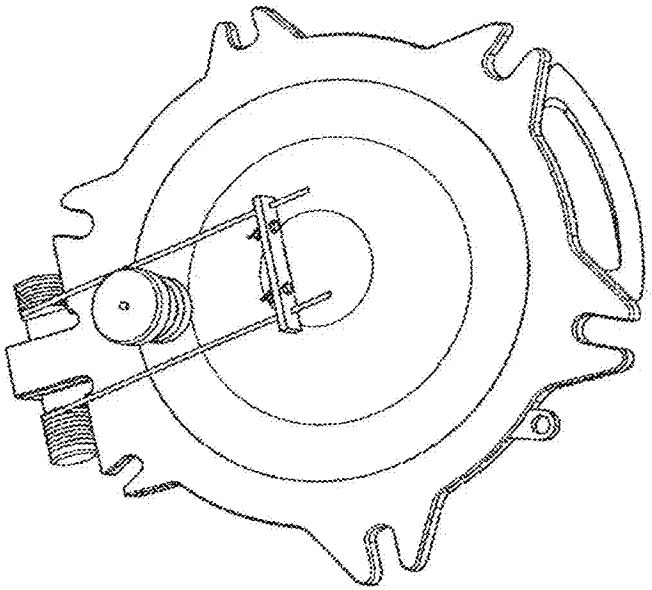
FIG. 3 is a top plan view of a prior art manway cover.
Figure 5:
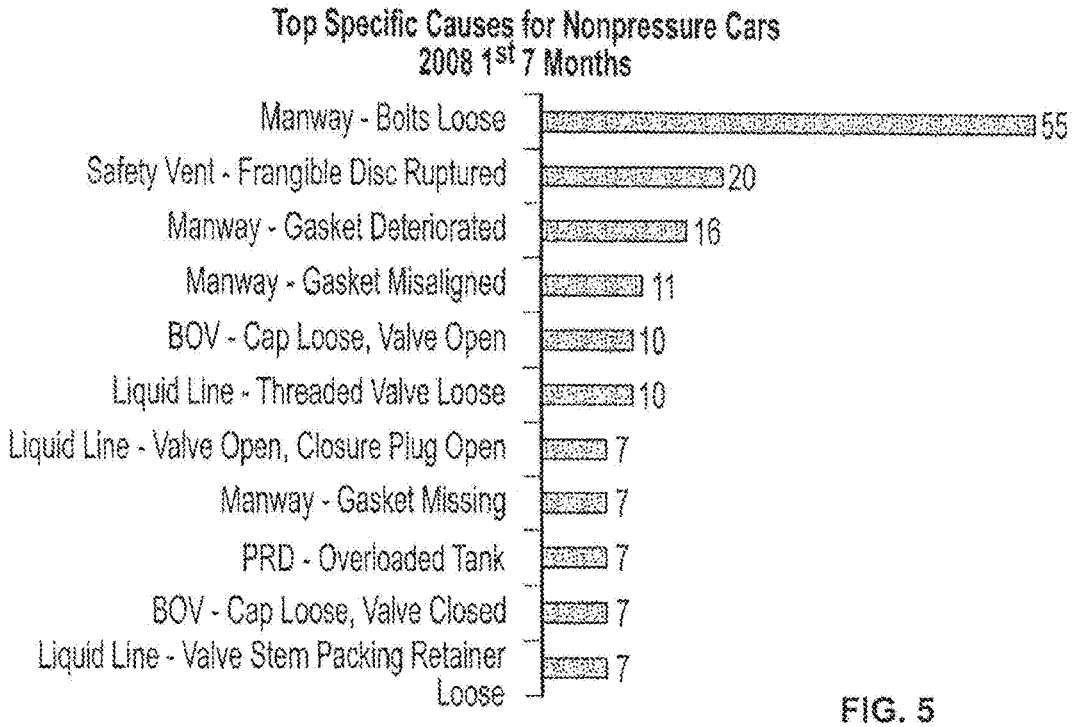
FIGS. 5 and 6 are graphs of data for non-accidental releases (NARs) for non-pressurized cars in transit.
Figure 6:
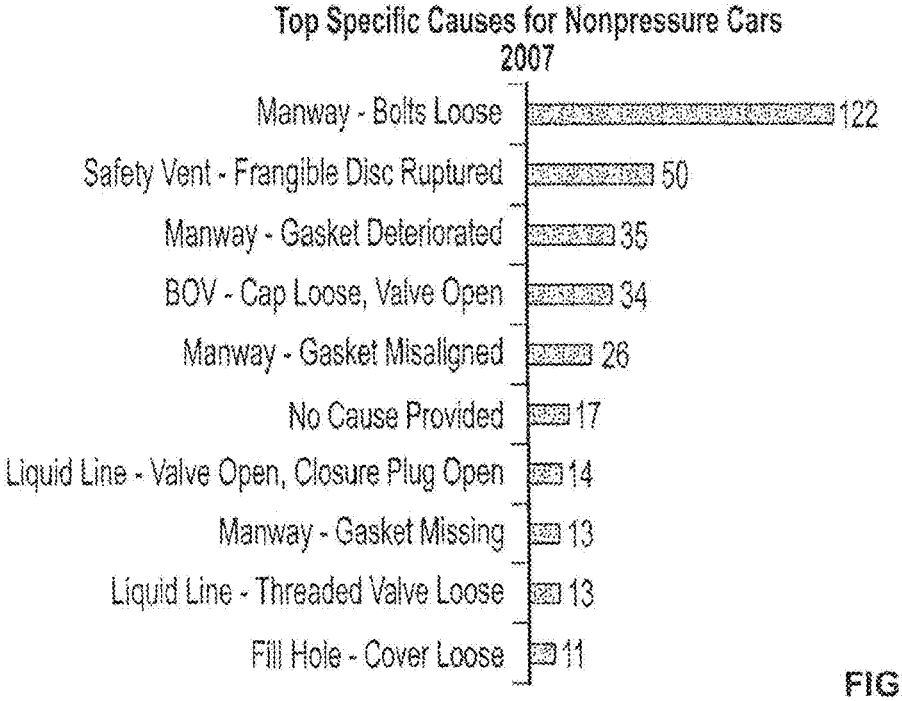
Figure 7:
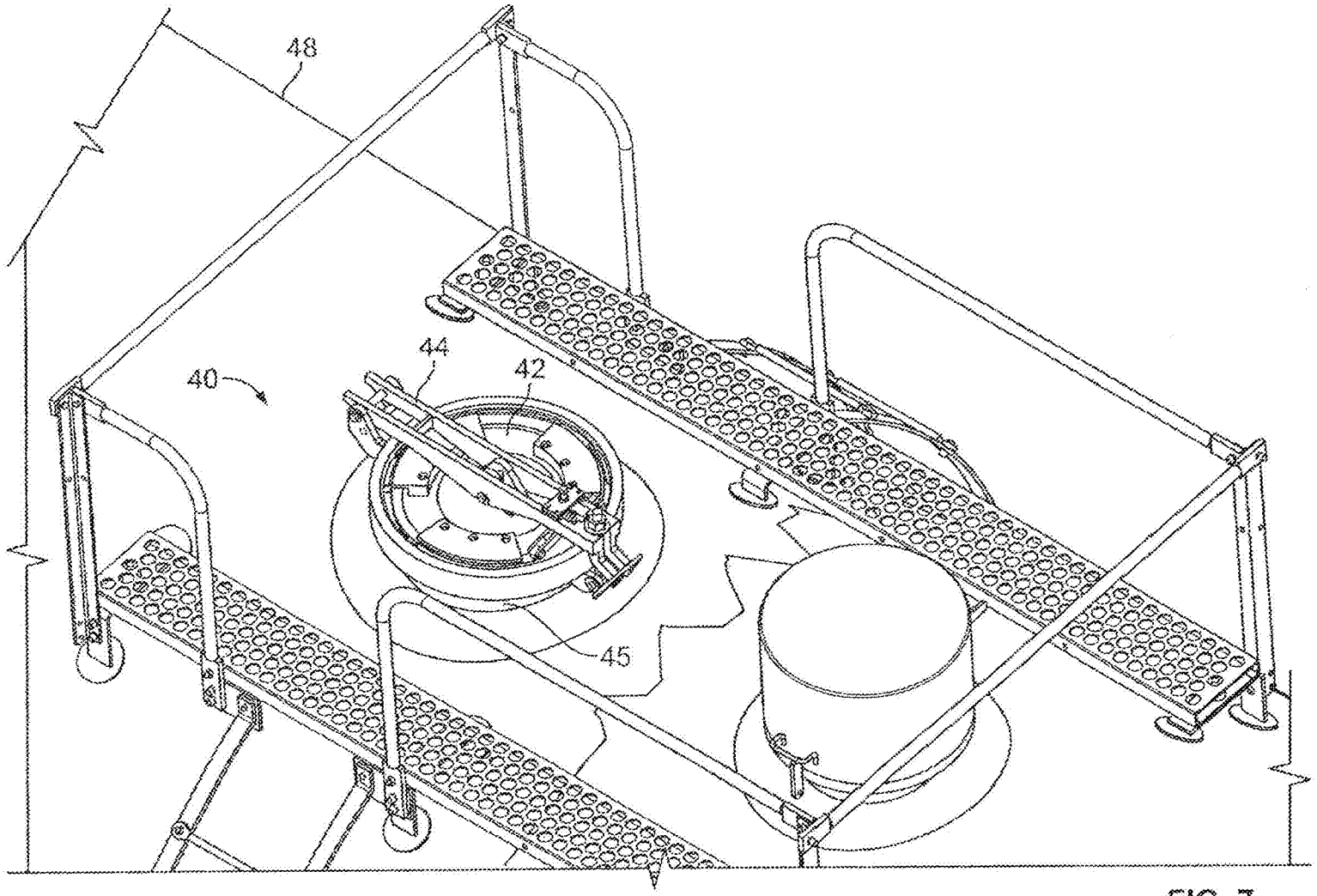
FIG. 7 is a perspective view of a first embodiment of the manway assembly of the present technology on a tank car in a closed configuration.

A first embodiment of the manway assembly of the present technology is indicated in general at 40 in FIG. 7. More specifically, the manway cover assembly 42 and a lift arm assembly 44 are mounted on the top of a nozzle assembly 45 which is positioned on top of tank car body 48. The nozzle of the nozzle assembly 45 defines a manway for accessing the interior of the tank car body 48, as described above. FIG. 7 illustrates the manway cover assembly 42 and lift arm assembly 44 in a closed configuration.

Figure 8:
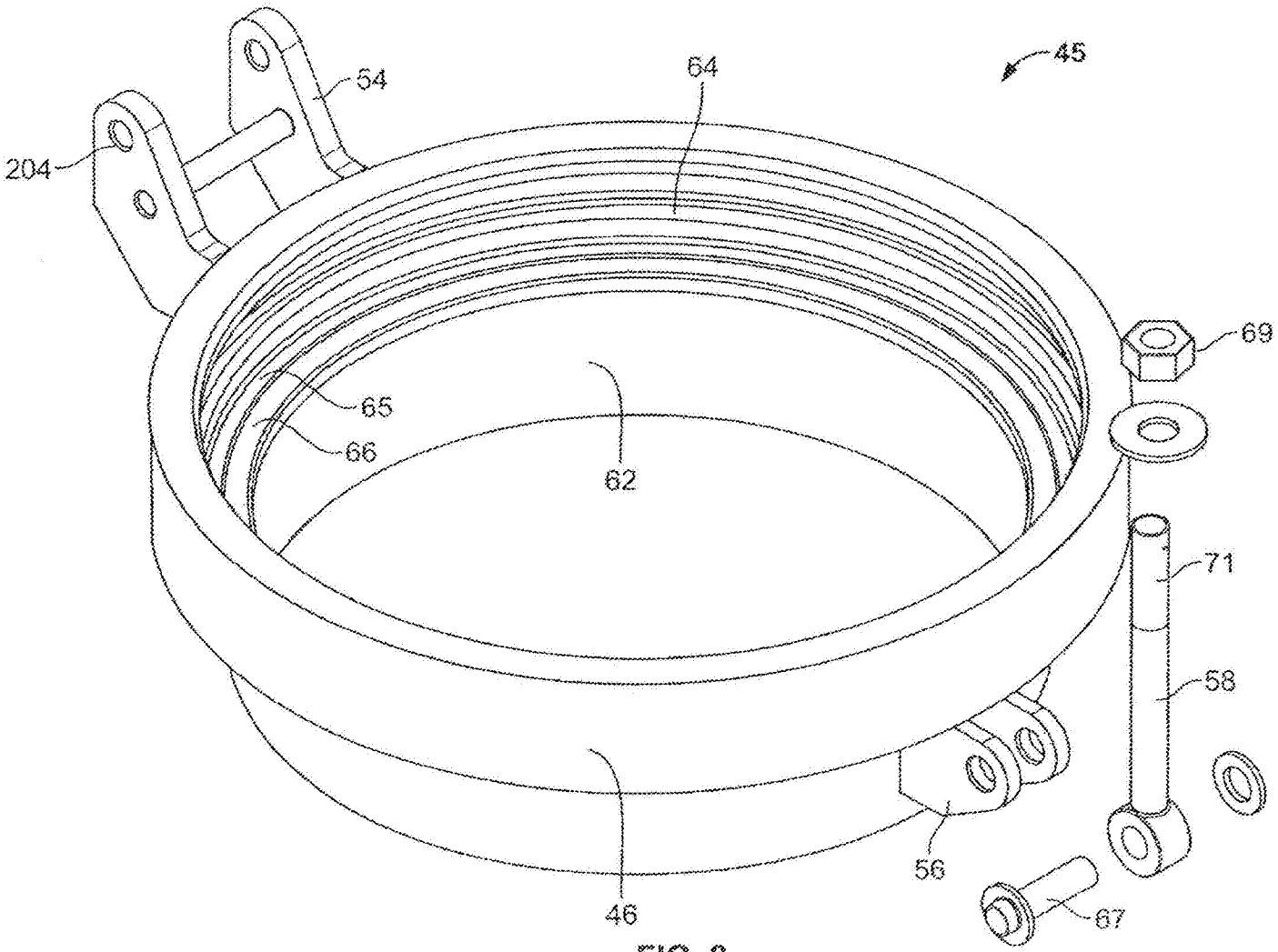
FIG. 8 is an enlarged perspective exploded view of the nozzle assembly of FIG. 7.

An enlarged, exploded perspective view of the nozzle assembly of the manway assembly of FIG. 7, indicated in general at 45, is presented in FIG. 8. In addition to the nozzle 46, the nozzle assembly includes a hinge 54, a pair of eye bolt lugs 56 and an eye bolt 58. The cylindrical interior wall 62 of the nozzle includes a circumferential groove 64 cut or otherwise formed therein, as well as an upper circumferential ledge 65 and a lower circumferential ledge 66.

Figure 11:
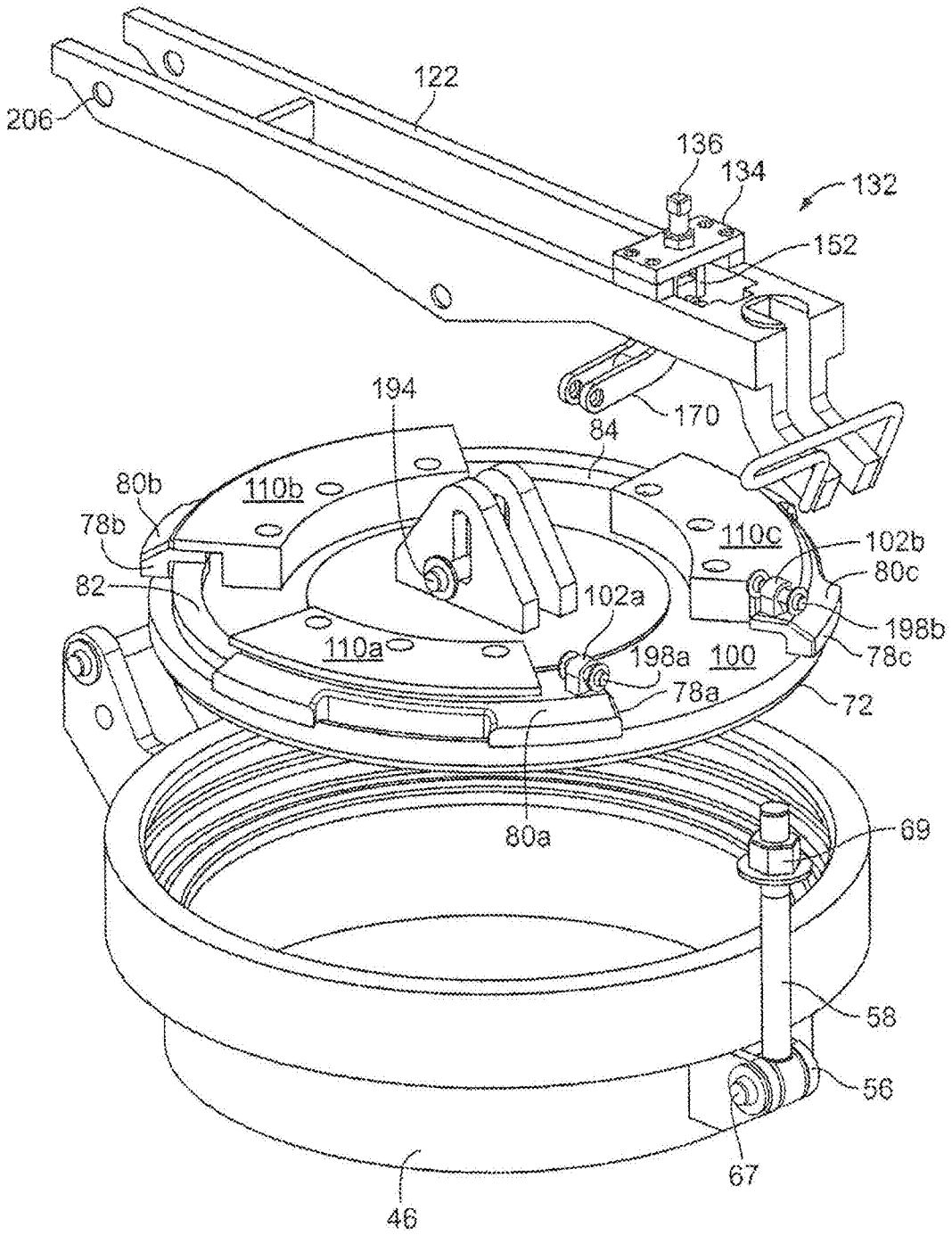
FIG. 11 is a perspective exploded view of the assembled nozzle, cover and lift arm assemblies of FIGS. 8-10.

As illustrated in FIG. 11, the eye bolt 58 is pivotally secured to the eye bolt lugs 56 by pin 67. An eye bolt nut 69 engages a threaded distal portion 71 of the eye bolt 58.

Figure 9:
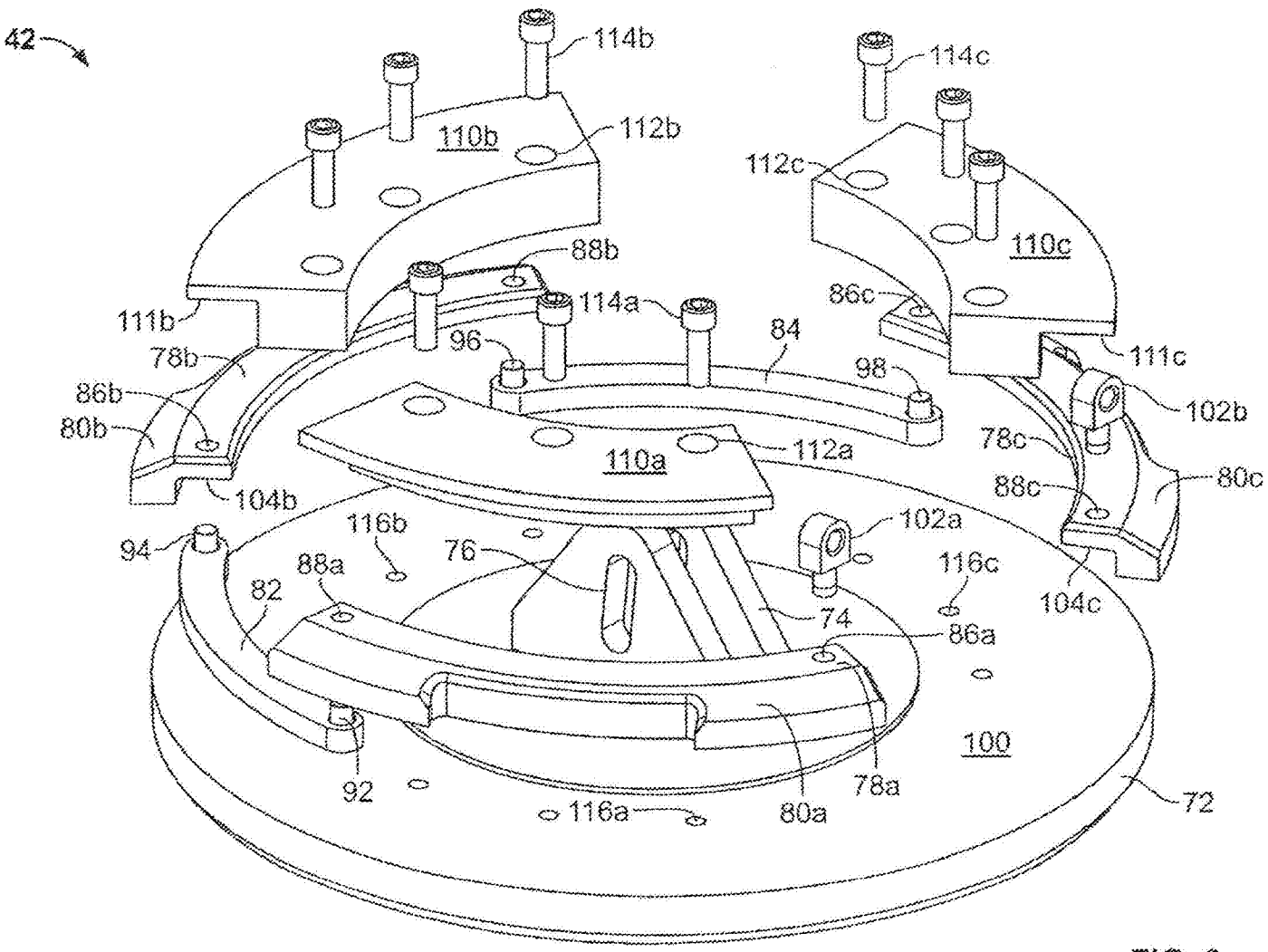
FIG. 9 is an enlarged perspective exploded view of the cover assembly of FIG. 7.

The cover assembly of the manway assembly of FIG. 7 is indicated in general at 42 in FIG. 9 in an exploded view. The cover assembly includes a disk-shaped cover 72 having a cover lift bracket 74. The cover lift bracket is generally triangular-shaped, is centrally located on the top surface of the cover and includes elongated slots 76.

The cover assembly also includes latch segments that may take the form of wedge segments 78*a*-78*c*. The latch segments may take other forms, including those without a wedge surface. Each wedge segment is generally arc-shaped and features a wedge surface 80*a*-80*c*. Wedge segment 78*a* is connected to wedge segment 78*b* by an arc-shaped link 82, while wedge segment 78*b* is similarly connected to wedge segment 78*c* by arc-shaped link 84. More specifically, wedge segment 78*a* features pin openings 86*a* and 88*a*, wedge segment 78*b* features pin openings 86*b* and 88*b* and wedge segment 78*c* features pin openings 86*c* and 88*c*. Link 82 features pins 92 and 94, while link 84 features pins 96 and 98. Pin 92 of link 82 engages pin opening 88*a* of wedge segment 78*a* while pin 94 of link 82 engages pin opening 86*b* of wedge segment 78*b*. Pin 96 of link 84 similarly engages pin opening 88*b* of wedge segment 78*b* while pin 98 of link 84 similarly engages pin opening 86*c* of wedge segment 78*c*.

As illustrated in FIG. 11, the assembled wedge segments and links rest on the top surface 100 of the cover 72. Wedge segment 78*b* features a channel 104*b* formed along the underside of the inner edge which receives adjacent end portions of links 82 and 84. Wedge segment 78*c* similarly features a channel 104*c* formed along the underside of the inner edge which receives the adjacent end portion of link 84. Wedge segment 78*a* features a similar channel (not visible in FIG. 9) that receives the adjacent end portion of link 82.

The pins and pin openings described above are sized to permit pivoting movement between the links and wedge segments.

As illustrated in FIGS. 9 and 11, a pair of pivot lugs 102*a* and 102*b* are pivotally secured within pin opening 86*a* of wedge segment 78*a* and pin opening 88*c* of wedge segment 78*c*, respectively.

As illustrated in FIGS. 9 and 11, the cover assembly also features three generally arc-shaped retainer blocks 110*a*, 110*b* and 110*c*. As illustrated in FIG. 9, each retainer includes a channel formed along the underside of the outer edge (illustrated at 111*b* for retainer 110*b* and at 111*e* for retainer 110*c*, not visible for retainer 110*a* in FIG. 9). Each retainer features a set of three openings, illustrated at 112*a*, 112*b* and 112*c* in FIG. 9, that are sized to receive fasteners 114*a*, 114*b* and 114*c*, which are preferably socket head cap screws. As illustrated in FIG. 9, the top surface 100 of the cover 72 features openings 116*a*, 116*b* and 116*c*. As illustrated in FIG. 11, the fasteners secure the retainers 110*a*, 110*b* and 110*c* to the top surface of the cover via the retainer openings and the cover openings. The channels (such as 111*b* and 111*e* of FIG. 9) of the retainers are sized to secure the wedge segments to the cover lid, yet permit movement of the wedge segments parallel to the cover top surface as described below.

It should be noted that while three wedge segments, two links and three retainers are illustrated in the figures, alternative numbers of each component may be used instead (for example: four wedge segments joined by three links with four retainers, etc.).

Figure 10:
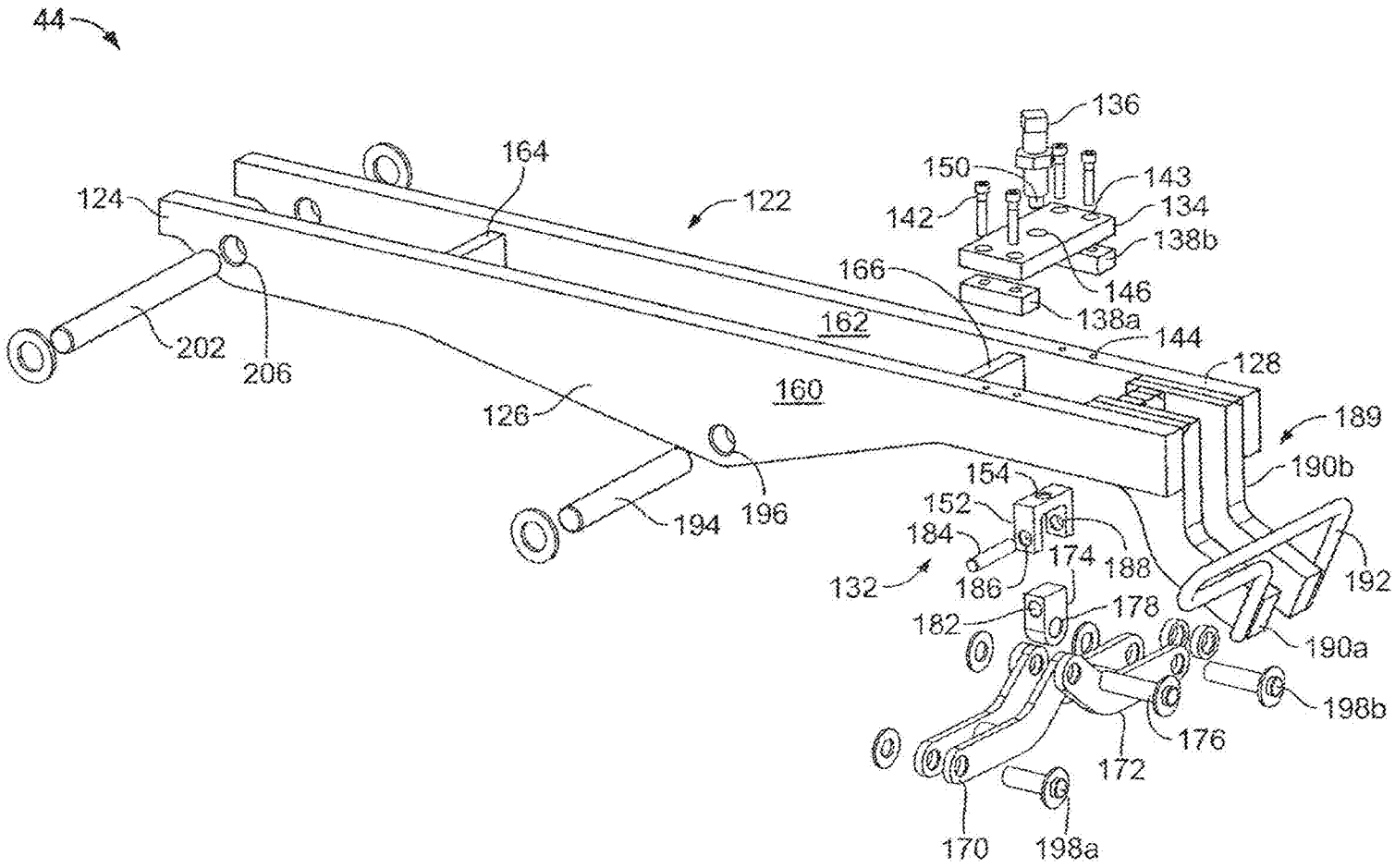
FIG. 10 is an enlarged perspective exploded view of the lift arm assembly of FIG. 7.

The lift arm assembly of the manway assembly of FIG. 7 is indicated in general at 44 in FIG. 10 in an exploded view. The lift arm assembly includes a lift arm, indicated in general at 122. The lift arm features a proximal portion 124, a middle portion 126 and a distal portion 128.

A latching mechanism, indicated in general at 132 in FIGS. 10 and 11, is mounted to the distal end of the lift arm. As illustrated in FIG. 10, the latching mechanism includes an adjusting plate 134, an adjusting screw 136, adjusting plate support blocks 138*a* and 138*b* and four adjusting plate fasteners 142. Four peripheral openings 143 are formed through the adjusting plate 134 and a corresponding four openings 144 are formed in the top surface of the lift arm 122 and through support blocks 138*a* and 138*b*. The adjusting plate, support block and lift arm openings are sized to be engaged by the adjusting plate fasteners 142. As illustrated in FIG. 11, the adjusting plate 134 is secured to the lift arm by the adjusting plate fasteners and the adjusting plate support blocks.

The adjusting plate features a central opening 146 that is sized to receive the adjusting screw 136 so that the adjusting screw is free to rotate about a vertical axis. The bottom portion of the adjusting screw is provided with a reduced diameter portion 150 that is secured to a pivot block 152 via opening 154 (such as by threads or a rivet-type connection). Pivot block 152 features an inverted, generally U-shaped profile.

As illustrated in FIG. 10, the lift arm 122 is constructed from a pair of beams 160 and 162 that are secured to one another by spacers 164 and 166. When the lift arm assembly is assembled, as illustrated in FIG. 11, the pivot block 152 is positioned between the lift arm beams 160 and 162 and spacers 164 and 166 provide sufficient space between the beams for the pivot block to rotate 360° when adjusting screw 136 is turned.

Returning to FIG. 10, an inner linkage 170 and an outer linkage 172 are pivotally secured by their proximal ends to a clevis 174 by pin 176, which engages clevis linkage opening 178. The clevis 174 is secured to the pivot block via clevis transverse opening 182, pin 184 and pivot block openings 186 and 188.

The lift arm features a safety catch, indicated in general at 189 in FIG. 10, which includes spaced gooseneck members 190*a* and 190*b* and upon which a combination handle and safety stop 192 is positioned. The functionality of the safety catch and combination handle and safety stop will be explained below.

Figure 12:
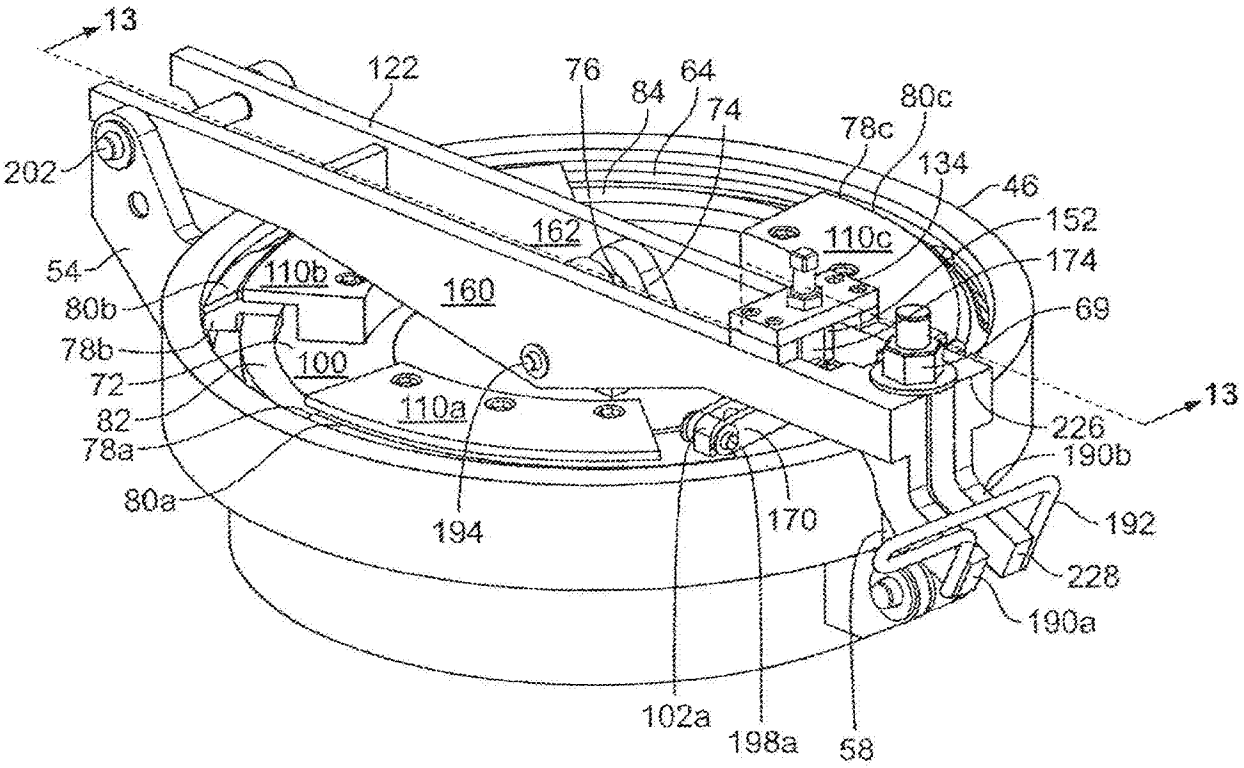
FIG. 12 is a perspective assembled view of the manway assembly of FIG. 11 in the closed configuration.

As illustrated in FIG. 12, the cover assembly of FIGS. 9 and 11 is attached to the lift arm of FIGS. 10 and 11 by a pin 194 (also shown in FIGS. 10 and 11). The pin 194 engages openings 196 (FIG. 10) formed through the middle portion 126 of beams 160 and 162 as well as the elongated slots 76 of cover lift bracket 74 (FIG. 9).

In addition, with reference to FIGS. 9-12, the distal ends of the inner and outer linkages 170 and 172 of the latching mechanism of the lift arm assembly are pivotally connected to pivot lugs 102*a* and 102*b*, respectively, by pins 198*a* and 198*b*.

As illustrated in FIG. 12, the proximal portion of the lift arm 122 is secured to the hinge 54 of the nozzle assembly by pin 202 which passes through openings in the hinge and the proximal portion of the lift arm (204 of FIG. 8 and 206 of FIG. 10, respectively).

When the cover 72 is in the closed configuration illustrated in FIG. 12, the eye bolt 58 is pivoted up and into a generally vertical position, during which it passes between the spaced gooseneck members 190*a* and 190*b* of the safety catch and ultimately into the fully latched position illustrated in FIG. 12. The eye bolt nut 69 is then tightened down so secure the manway assembly in the closed configuration.

Figure 13:
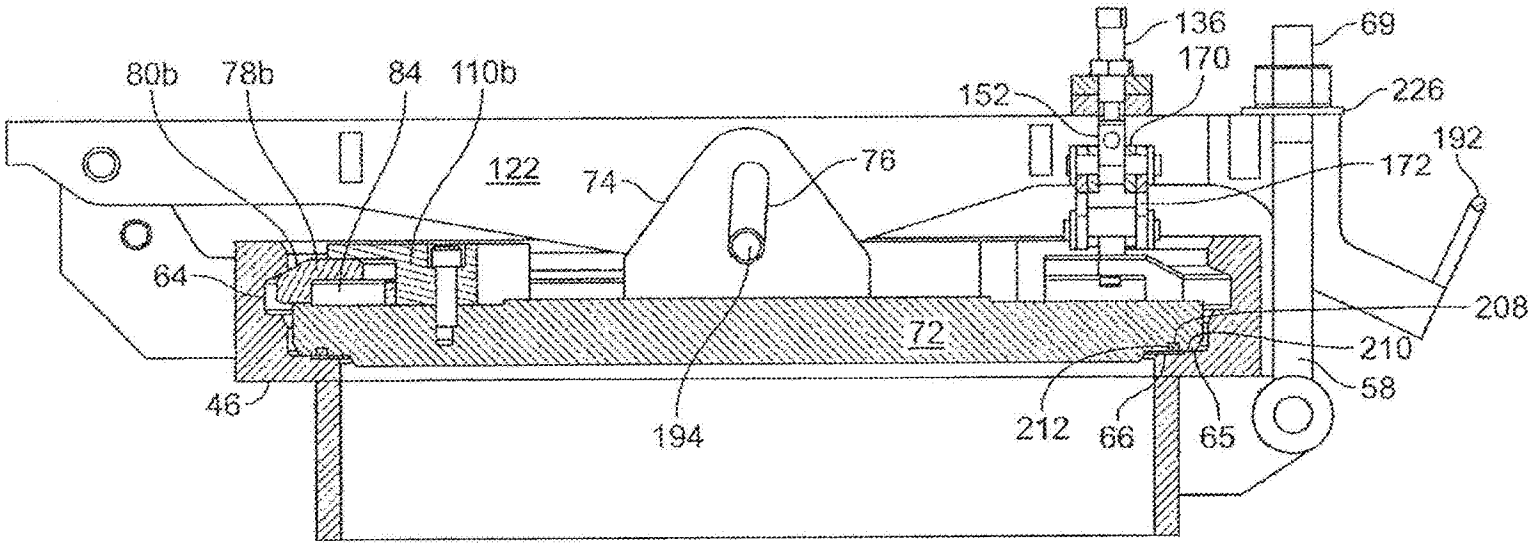
FIG. 13 is a cross sectional view of the manway assembly of FIG. 12 taken along a vertical cutting plain passing through line 13-13 of FIG. 12.

As illustrated in FIGS. 12 and 13, when the lift arm and cover are in the fully closed positions, the distal ends of the inner and outer linkages 170 and 172 of the cover assembly latching mechanism, and thus the pivot lugs 102*a* and 102*b* of the cover assembly, are maximum distance from one another (see also FIGS. 10 and 11). With reference to FIGS. 12 and 13, this causes the linkages 82 and 84 and wedge segments to be positioned as radially outward towards the circumferential edge of the top surface 100 of the cover 72 as possible. As a result, as illustrated in FIGS. 12 and 13, the wedge surfaces 80*a*-80*c* of the wedge segments 78*a*-78*c* are in engagement with the circumferential groove 64 of the nozzle 46. The degree of engagement of the wedge segments with the nozzle circumferential groove can be adjusted by turning the latching mechanism adjusting screw 136. As best illustrated in FIG. 13, it should also be noted that pin 194 attaching the cover to the middle portion of the lift arm is positioned at the bottom of the elongated slots 76 of the cover lift bracket 74 when the cover and lift arm are in the closed configuration.

Figure 14:
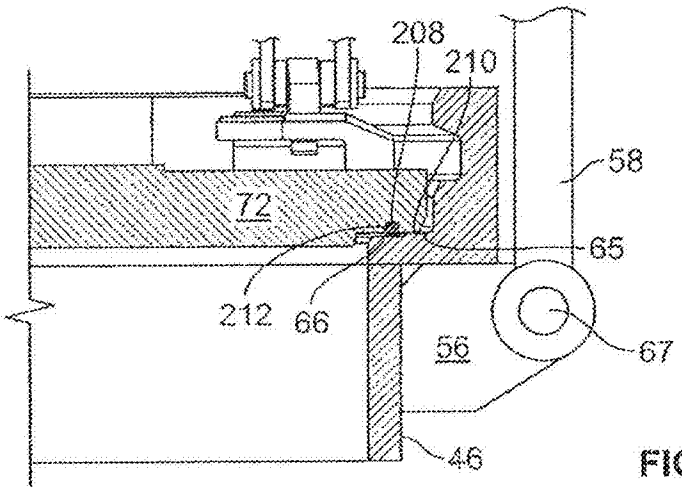
FIG. 14 is an enlarged view of portions of the nozzle, cover and lift arm of FIG. 13 showing the detail of the seal between the cover and nozzle.

As illustrated in FIGS. 13 and 14, the underside edge portion of the cover 72 is provided with a circumferential seal channel 208 and a circumferential stop portion 210. A circumferential seal 212 is positioned within the seal channel 208 with a portion of the seal extending radially inward from the seal channel (towards the center of the cover 72). As illustrated in FIGS. 13 and 14, when the cover and lift arm are in the closed configuration, and the wedge segments of the cover assembly are engaging the circumferential groove of the nozzle, the circumferential seal 212 is gently compressed against the lower circumferential ledge 66 of the nozzle. As illustrated in FIGS. 13 and 14, the circumferential stop portion 210 of the cover 72 engages the upper circumferential ledge 65 of the nozzle to limit compression of the seal 212.

Figure 15:
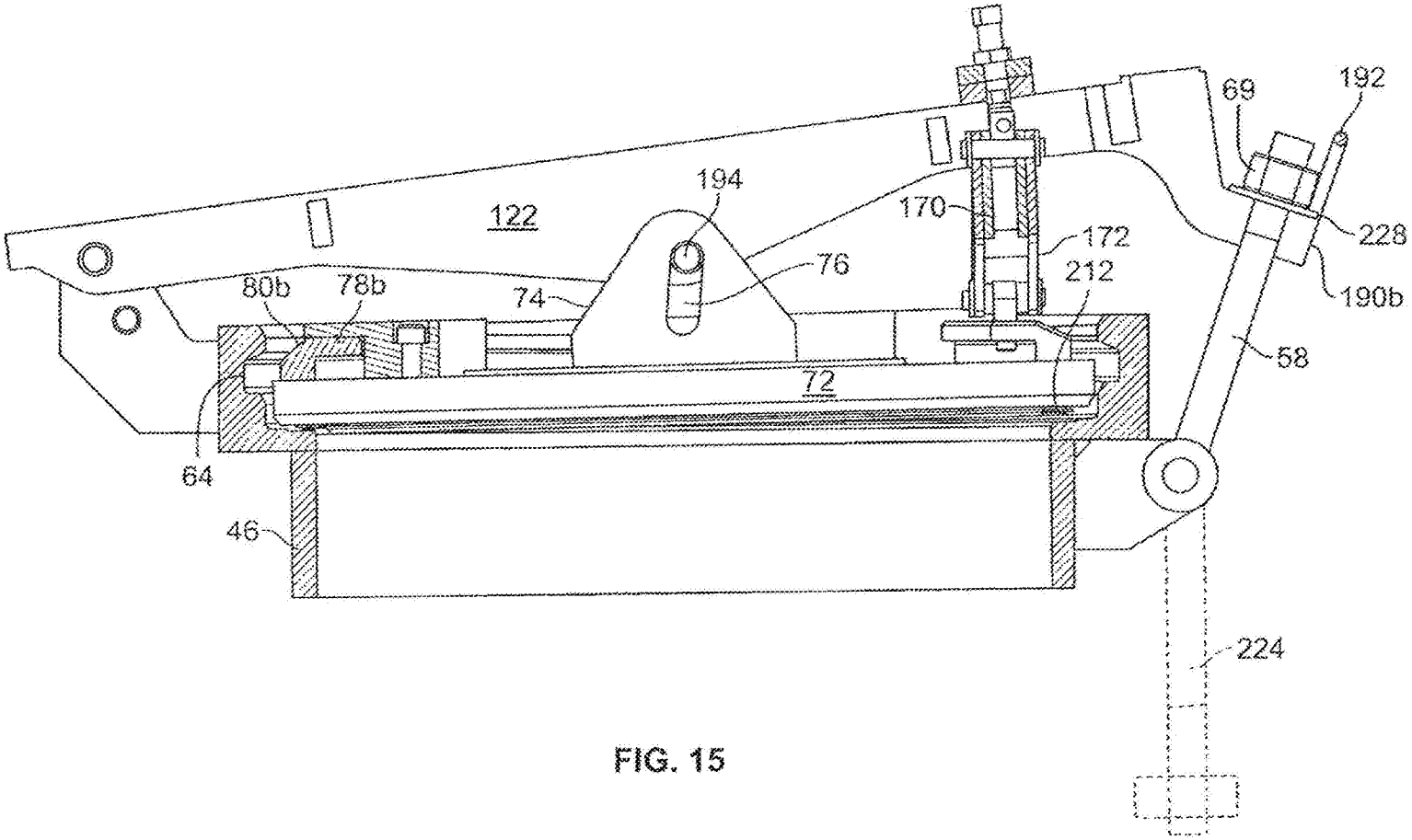
FIG. 15 is a cross sectional view of the nozzle and lift arm of FIG. 12 taken along a vertical cutting plain passing through line 13-13 of FIG. 12 and a side elevation view of the cover of FIG. 12 in a partially open configuration.

With reference to FIG. 13, when a user wishes to open the cover 72 of the manway assembly, the eye bolt nut 69 is first loosened. If there is no pressure in the tank car, the user may pivot the eye bolt 58 down until it abuts the handle and safety stop 192 of the closed lift arm and cover. The user may then lift up on the lift arm via the handle and safety stop 192 until the lift arm and cover reach the position illustrated in FIG. 15. With reference to FIG. 15, as the lift arm 122 moves up and away from the cover 72, pin 194 travels upward in elongated slot 76 of the cover lift bracket 74. As this occurs, the distal ends of the inner and outer linkages 170 and 172 of the latching mechanism of the lift arm assembly, and thus pivot lugs 102*a* and 102*b* of the cover assembly, move towards one another. With reference to FIGS. 12 and 15, this causes the linkages 82 and 84 (FIG. 12) and wedge segments 78*a*-78*c* (FIG. 12) to move radially inward towards the center of the cover 72. As a result, the wedge surfaces 80*a*-80*c* (FIG. 12) of the wedge segments disengage the circumferential groove 64 (FIG. 12) of the nozzle 46, as illustrated for wedge surface 80*b* of wedge segment 78*b* in FIG. 15.

Figure 16:
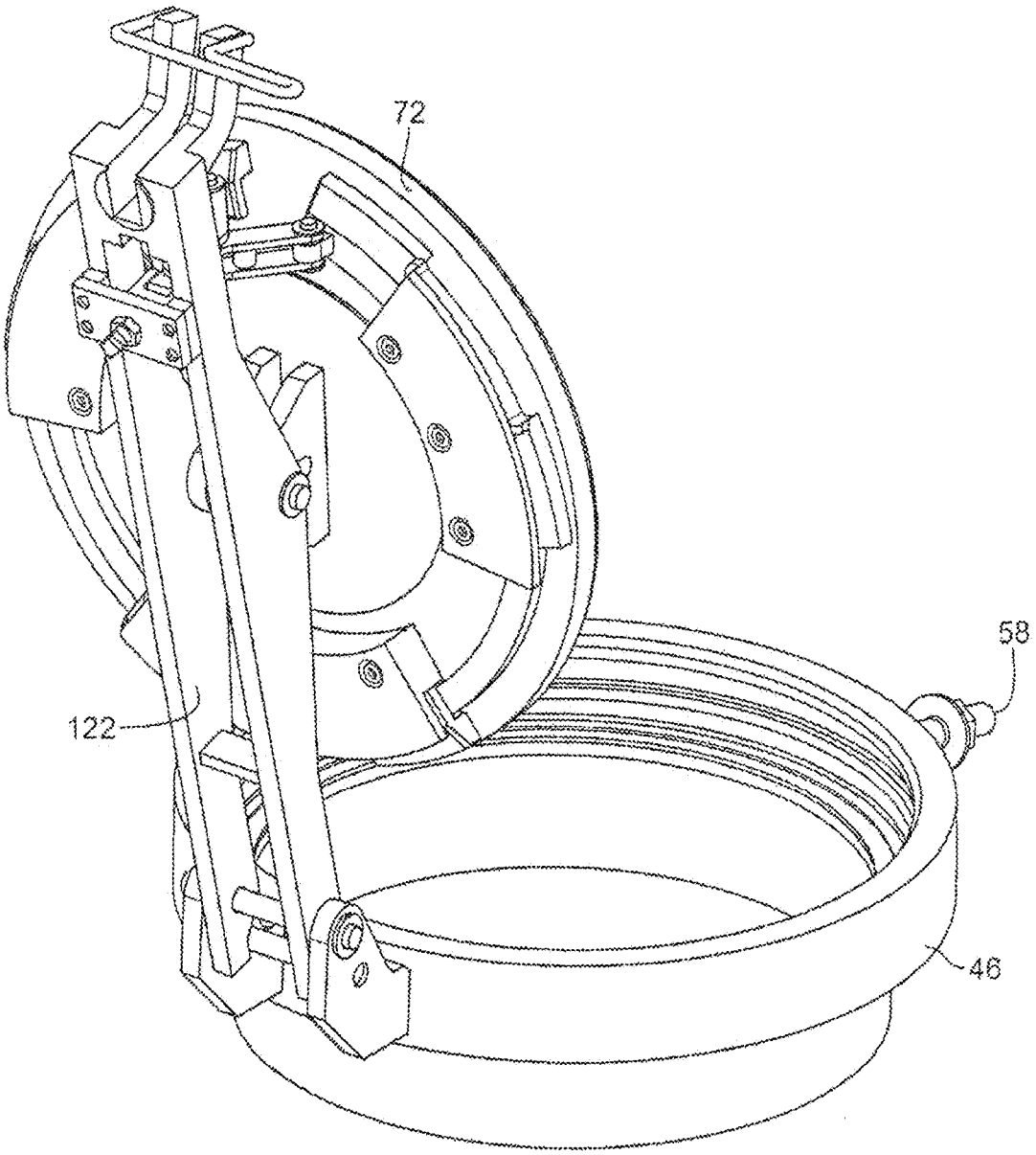
FIG. 16 is a perspective view of the manway assembly of FIG. 12 in an open configuration.

At this point (illustrated in FIG. 15), the user may pass the eye bolt 58 and the eye bolt nut 69 under the handle and safety stop 192. The eye bolt 58 may then be pivoted down into a position directed vertically downward, illustrated in phantom at 224 in FIG. 15. The user is then free to pivot the lift arm and cover into the open position illustrated in FIG. 16.

The handle and safety stop 192 of FIGS. 12, 13 and 15 prevent a user from releasing the eye bolt 58 prior to venting if there is pressure in the tank car. More specifically, with reference to FIGS. 12 and 13, when the user loosens eye bolt nut 69, the cover 72 will typically rise slightly, due to the pressure in the tank acting on the underside of the cover 72, so that the pressure within the tank car may vent through the circumferential space formed between the cover and the nozzle. The pressure of the top surface of the lift arm 122 against the bottom surface of the nut 69 prevents the user from pivoting the eyebolt 58 down over the lifting arm distal end corner 226 (FIGS. 12 and 13) until after the venting is complete. Once venting has completed, the lid 72 will lower back into its original closed configuration, and the user may continue to loosen the nut 69. The cover may then be opened following the procedure described above.

In some situations, the cover 72 may become stuck in the closed configuration illustrated in FIGS. 12 and 13, even though the eye bolt nut 69 has been loosened and pressure exists within the tank car tank. In such a situation, the nut 69 may be loosened, but when the eye bolt is pivoted downward, it will contact the handle and safety stop 192 of the closed lift arm and cover. It is impossible for the user to pivot the eye bolt 58 down beyond the handle and safety stop 192 when the cover 72 is fully closed.

The user may pull up on the handle and safety stop 192 until the cover becomes un-stuck. Alternatively, the cover may become un-stuck on its own. When this occurs, the pressure in the tank acting on the underside of the cover 72 will cause it to rise and, as a result, pressure from within the tank will vent through the circumferential space formed between the cover and the nozzle. In addition, due to the pressure within the tank acting on the underside of the cover 72, the top surfaces of the spaced gooseneck members 190*a* and 190*b* of the safety catch on the lift arm will press up against the bottom surface of the nut 69. This prevents the user from further pivoting the eye bolt downwards over corner 228 (FIGS. 12 and 15) of the safety catch until venting is completed. When the venting is complete, the lift arm, cover and eyebolt will be in the positions illustrated in FIG. 15. The eye bolt 58 may then be pivoted down into a position directed vertically downward, illustrated in phantom at 224 in FIG. 15. The user is then free to pivot the lift arm and cover into the open position illustrated in FIG. 16. As a result, the lift arm, safety catch, handle and safety stop and eye bolt provide two levels of protection from tank pressure—one when the cover is not stuck in a closed configuration and one when the cover is stuck in a closed configuration.

Figure 17:
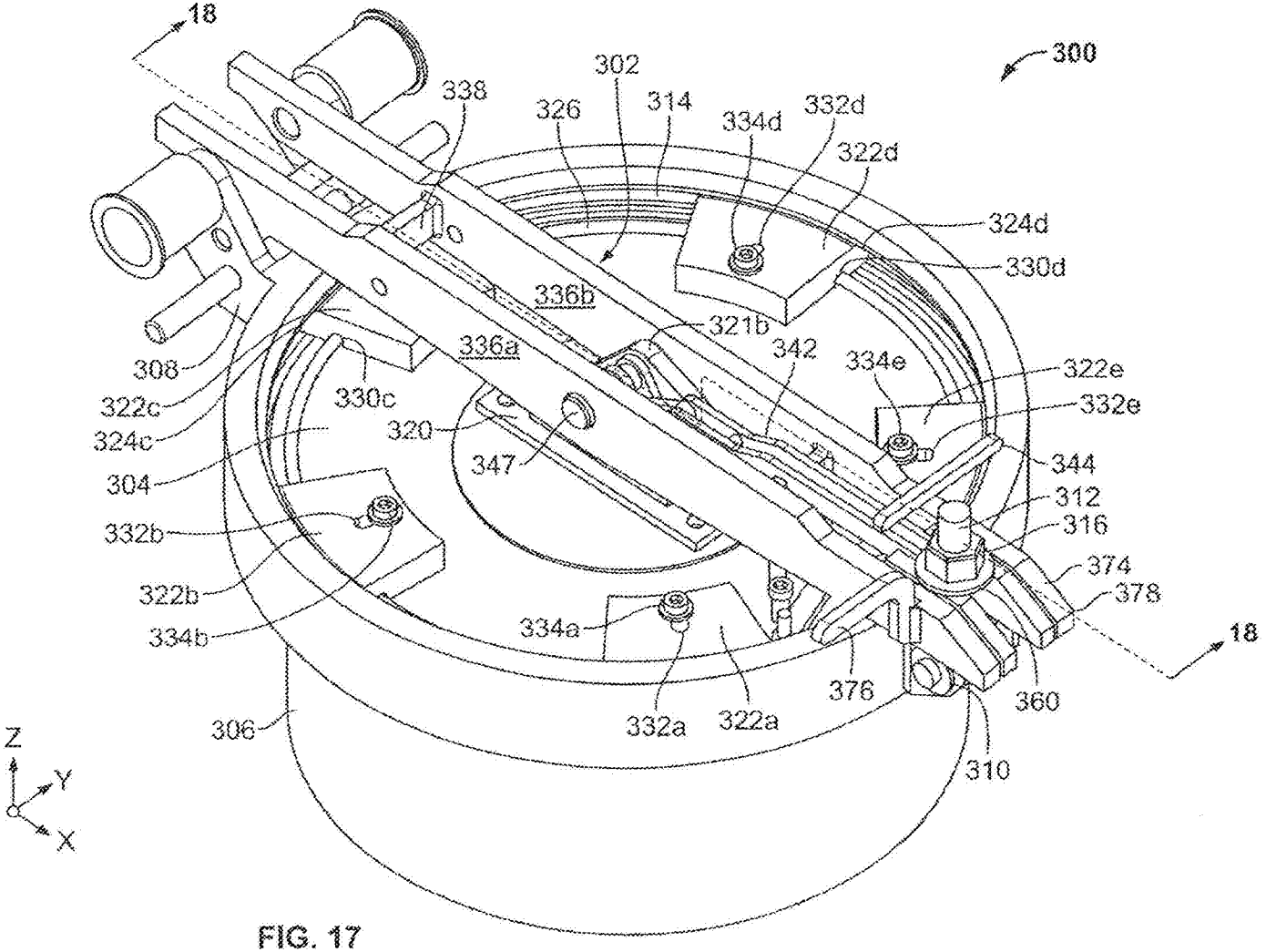
FIG. 17 is a perspective view of a second embodiment of the manway assembly of the present technology in a closed configuration.
Figure 18:
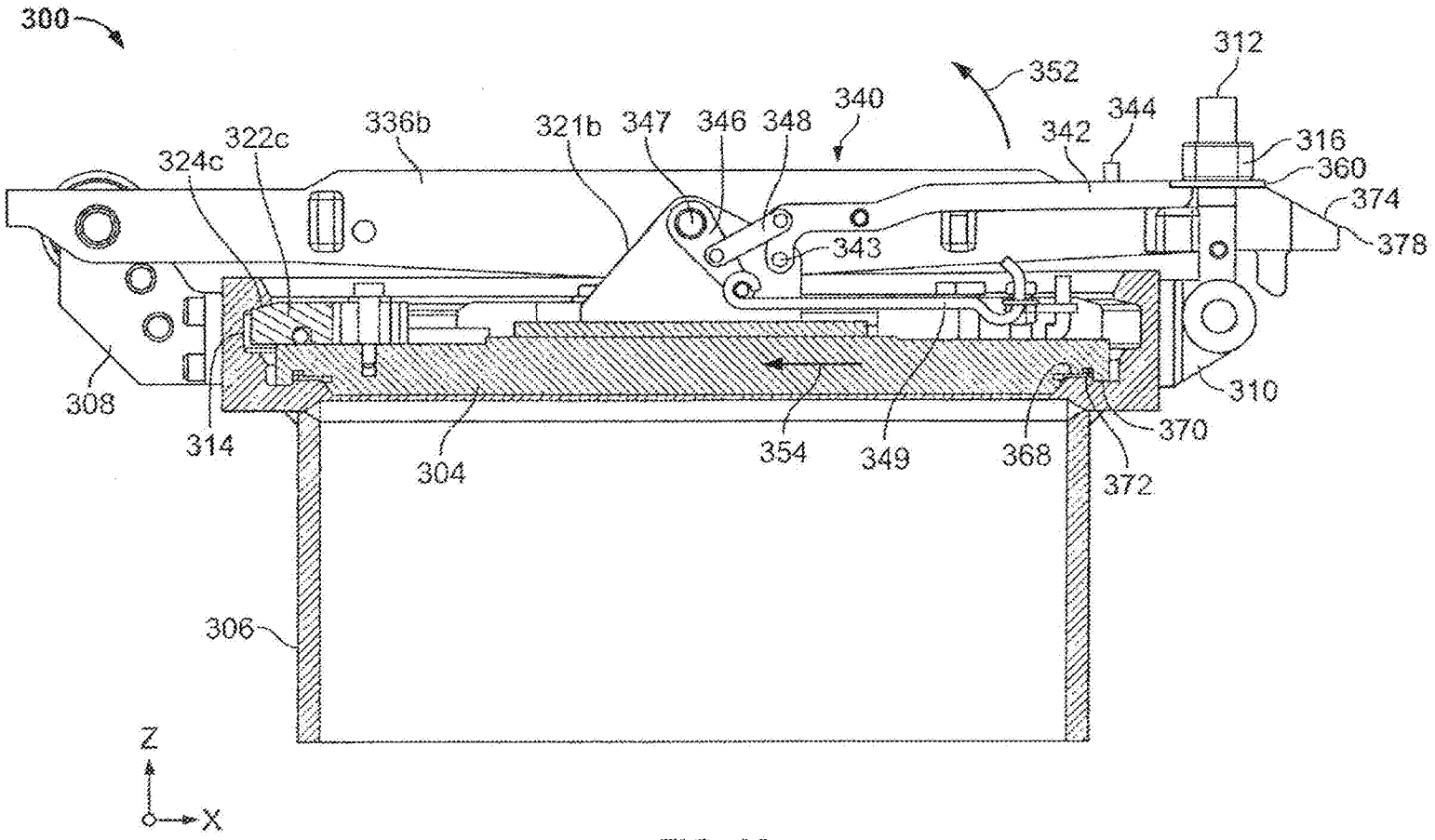
FIG. 18 is a cross sectional view of the nozzle, lift arm and cover of FIG. 17 taken along vertical cutting plain passing through line 18-18 of FIG. 17.

A second embodiment of the manway assembly of the present technology is indicated in general at 300 in FIGS. 17 and 18. The manway assembly 300 includes a lift arm, indicated in general at 302, mounted on the top of cover 304, both of which are positioned on a nozzle 306 which is positioned on top of a tank car body (such as 48 in FIG. 7). The nozzle defines a manway for accessing the interior of the tank car body, as described above. FIGS. 17 and 18 illustrate the manway cover and lift arm in a closed configuration.

Similar to the construction illustrated in FIG. 8, the nozzle 306 is provided with a pair of hinge lugs 308, a pair of eye bolt lugs 310 and an eye bolt 312. The cylindrical interior wall of the nozzle 306 includes a circumferential groove 314 cut or otherwise formed therein. The eye bolt 312 is pivotally secured to the eye bolt lugs 310. An eye bolt nut 316 engages a threaded distal portion of the eye bolt.

The disk-shaped cover 304 has a cover lift bracket 320. The cover lift bracket includes a pair of ears 321*a* and 321*b* and is centrally located on the top surface of the cover. The ears 321*a* and 321*b* include openings for connection to the lift arm and latching mechanism as explained below.

The cover is also provided with latch segments in the form of wedge segments 322*a*-322*e*. The latch segments may take other forms, including those without a wedge surface. Each wedge segment is generally arc-shaped and features a wedge surface, illustrated at 324*c* and 324*d* for wedge segments 322*c* and 322*d* (wedge segments 322*a*, 322*b* and 322*e* have similar wedge surfaces, but they are not visible in FIGS. 17 and 18).

Figure 19:
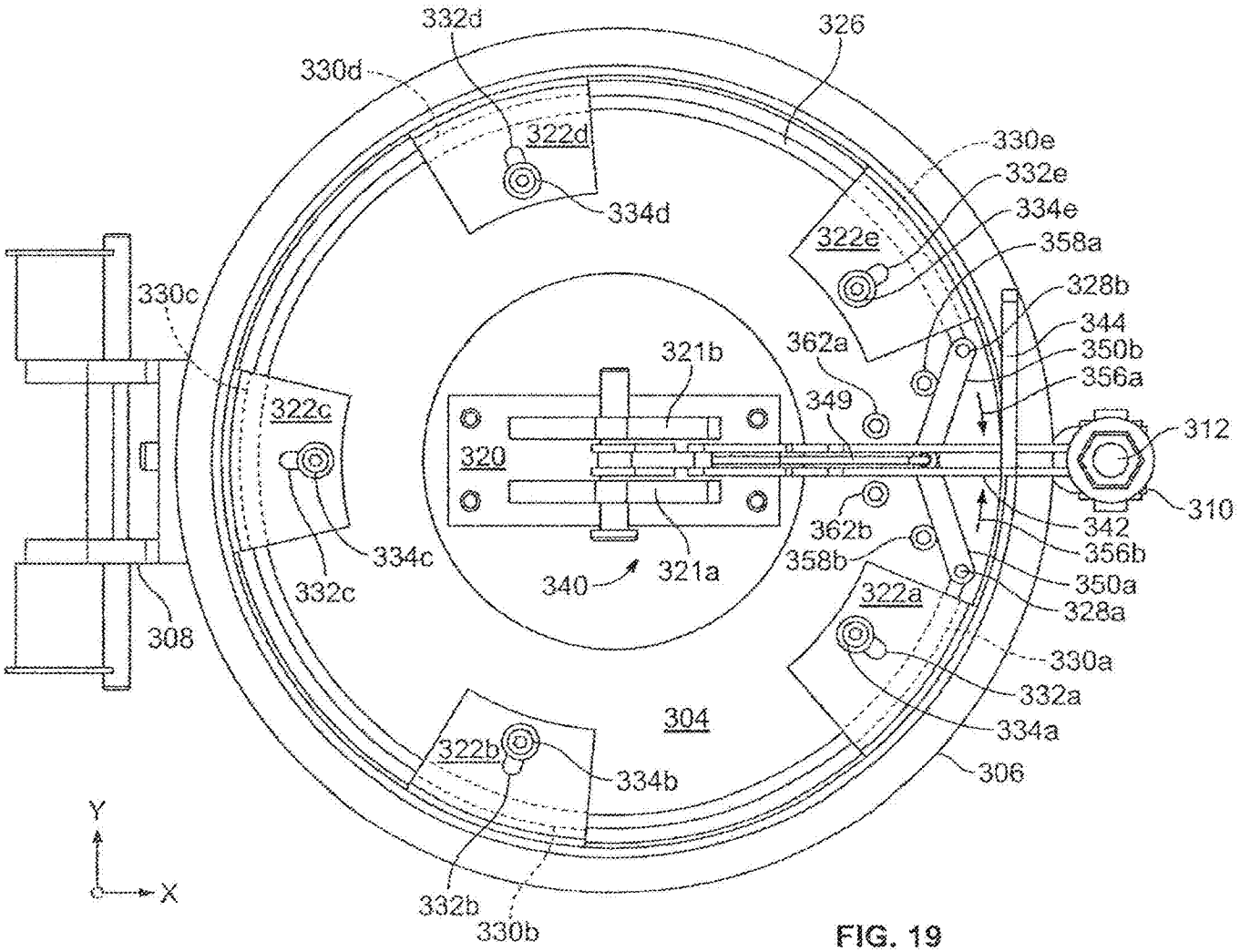
FIG. 19 is a top plan view of the manway assembly of FIG. 17 with the lift arm omitted for clarity.

As best illustrated in FIG. 19, wedge segments 322*a*-322*e* are connected together by a wire spring form 326. As illustrated in FIG. 19, wire spring form 326 is formed in a generally circular shape and features upturned ends 328*a* and 328*b*. The wire spring form 326 is constructed in such a matter to urge the wedge segments radially outward with respect to the center cover and into the positions illustrated in FIGS. 17-19. As an example only, the wire spring form material may be 5/16" diameter steel wire, hard drawn ASTM A 227, finish zinc plate-baked.

The assembled wedge segments and wire spring form rest on the top surface of the cover 304. Wedge segments 322*a*-322*e* feature arcuate channels (illustrated in phantom at 330*a*-330*e* in FIG. 19) formed along their undersides that receive the wire spring form, as illustrated in FIG. 17.

As best illustrated in FIGS. 17 and 19, each wedge segment includes an elongated slot (332*a*-322*e*). Retainer bolts 334*a*-334*e* pass through each slot and into bores formed through the top surface of the cover 304 so that the wedge segments are secured to the top surface of the cover. The slots 332*a*-332*e* and retainer bolts 334*a*-334*e* are sized so that the wedges may be moved between a locked position, where the wedge surfaces of the wedge segments 322*a*-322*e* engage the circumferential groove 314 of the nozzle 306 (as illustrated in FIG. 17), and an unlocked position, where the wedge segments are disengaged from the nozzle circumferential groove.

It should be noted that while five wedge segments are illustrated in the figures, alternative numbers of the wedge segments may be used instead.

As illustrated in FIG. 17, the latching arm 302 includes a pair of lift arm rails 336*a* and 336*b* joined by cross member 338. A latching mechanism, indicated in general at 340 in FIGS. 18 and 19, is mounted to the distal end of the lift arm between lift arm rails 336*a* and 336*b*. The latching mechanism includes a latch arm 342 having a distal end that is provided with a latch handle 344.

As illustrated in FIG. 18, the proximal end of the latch arm 342 is pivotally mounted between the ears 321*a* and 321*b* of the cover lift bracket by pin 343. In addition, a main link 346 is pivotally attached between ears 321*a* and 321*b* by pin 347. A cross link 348 is pivotally attached at opposite ends to the proximal end of the latch arm 342 and the main link 346.

As illustrated in FIGS. 18 and 19, a hook link 349 is pivotally connected by its proximal end to the bottom of main link 346. The distal end of the hook link engages openings formed in the proximal portions of a pair of spring form links 350*a* and 350*b*. While a hook is illustrated for the hook link, it should be noted that the hook link does not necessarily require a hook end—it may be attached to the proximal portions of the pair of spring form links by other fastening arrangements. As illustrated in FIG. 19, the distal ends of the spring form links 350*a* and 350*b* are engaged by the upturned ends 328*a* and 328*b* of the spring form 326.

A user operates the latching mechanism 340 to release the wedge segments of the cover from engagement with the circumferential groove of the nozzle as follows. The user raises the latch arm 342 via handle 344 and the latch arm 342 is pivoted counter-clockwise (in the direction of arrow 352 of FIG. 18) about pin 343. As this occurs, cross link 348 acts on main link 346 so that the main link 346 moves clockwise about pin 347. This causes the hook 349 to move towards the center of the cover (and parallel with the top surface of the cover) in the direction indicated by arrow 354 of FIG. 18. With reference to FIG. 19, as hook 349 moves, it causes the spring form links 350*a* and 350*b* to pivot about, in the directions of arrows 356*a* and 356*b*, and slide along outer fulcrum pins 358*a* and 358*b*. This causes the ends of the wire spring form 326 to be drawn closer together. As the proximal ends of the spring form links 350*a* and 350*b* travel further towards the center of the cover, they encounter inner fulcrum pins 362*a* and 362*b* which further drives their distal ends, and thus the free ends of the spring form, closer together. This causes the wedge segments 322*a*-322*e* to move radially inward (towards the center of the cover) so that their wedge surfaces disengage from the circumferential groove (314 of FIGS. 17 and 18) of the nozzle.

The positioning of the outer fulcrum pins 358*a* and 358*b* and the inner fulcrum pins 362*a* and 362*b* provide smooth operation of the latch arm as a greater torque is applied to pulling the ends of the spring form towards one another during initial upward movement of the latch arm. In addition, the positioning of the inner and outer fulcrum pins and the sizing of the spring form links and hook cause the spring form to maintain a generally round shape as the ends 328*a* and 328*b* of the spring form are drawn closer together. This gives generally uniform disengagement of the wedge segments from the nozzle circumferential groove.

As illustrated in FIGS. 17 and 18, the cover 304 is attached between the rails 336*a* and 336*b* of the lift arm 302 by pin 347. The pin 347 engages openings formed through the middle portion of rails 336*a* and 336*b* as well as openings through the ears 321*a* and 321*b* of the cover lift bracket. In addition, the proximal portion of the lift arm 302 is pivotally secured to the hinge lugs 308 of the nozzle.

When the cover 304 is in the closed configuration illustrated in FIGS. 17-19, the eye bolt 312 is pivoted up and into a generally vertical position illustrated, during which it passes between the spaced rails 336*a* and 336*b* of the lift arm. The eye bolt nut 316 is tightened down so secure the manway assembly in the closed configuration. In addition, as illustrated in FIG. 18, a washer 360 is positioned under eye bolt nut 316. This washer engages the distal tip of the latch arm 342 so that it cannot be raised until the eyebolt nut is loosened, which guards against accidental actuation of the latch arm.

As illustrated in FIG. 18, the underside edge portion of the cover 304 is provided with a circumferential seal channel 368 and a circumferential stop portion 370. A circumferential seal 372 is positioned within the seal channel. As illustrated in FIG. 18, when the cover and lift arm are in the closed configuration, and the wedge segments of the cover assembly are engaging the circumferential groove of the nozzle, the circumferential seal 372 is gently compressed against the circumferential ledge of the nozzle. As illustrated in FIG. 18, the circumferential stop portion 370 of the cover 304 engages a second circumferential ledge of the nozzle to limit compression of the seal 372. Suitable seals are available, as an example only, from the Technetics Group (EnPro Industries) of Columbia, S.C.

With reference to FIGS. 17 and 18, when a user wishes to open the cover 304 of the manway assembly, the eye bolt nut 316 is first loosened and pivoted down to the inclined safety stop at the distal end of the lift arm, indicated at 374. With washer 360 out of the way, latch handle 342 may be pivoted as described above to unlock the cover from the nozzle. If there is no pressure in the tank car, the user may further loosen the nut 316 and pivot the eye bolt 312 down clear of the lift arm and the lift arm handle 376, also attached near the distal end of the lift arm 302, may be used to lift the cover into the open position.

The lift arm safety stop 374 prevents a user from releasing the eye bolt prior to venting if there is pressure in the tank car. More specifically, when the user loosens eye bolt nut 316, pivots the eye bolt 312 so that it is positioned over the safety stop and actuates the latching mechanism as described above to unlock the cover, the cover 304 will typically rise slightly, due to the pressure in the tank acting on the underside of the cover, so that the pressure within the tank car may vent through the circumferential space formed between the cover and the nozzle. The pressure of the top surface of the lift arm safety stop 374 against the bottom surface of the washer 360 (as held in place by eye bolt nut 316) prevents the user from pivoting the eyebolt 312 further down over the lifting arm distal end corner 378 (FIGS. 17 and 18) until after the venting is complete. Once venting has completed, the lid 304 will lower back into its original closed configuration, and the user may continue to loosen the nut 316. The cover may then be opened following the procedure described above.

Figure 20:
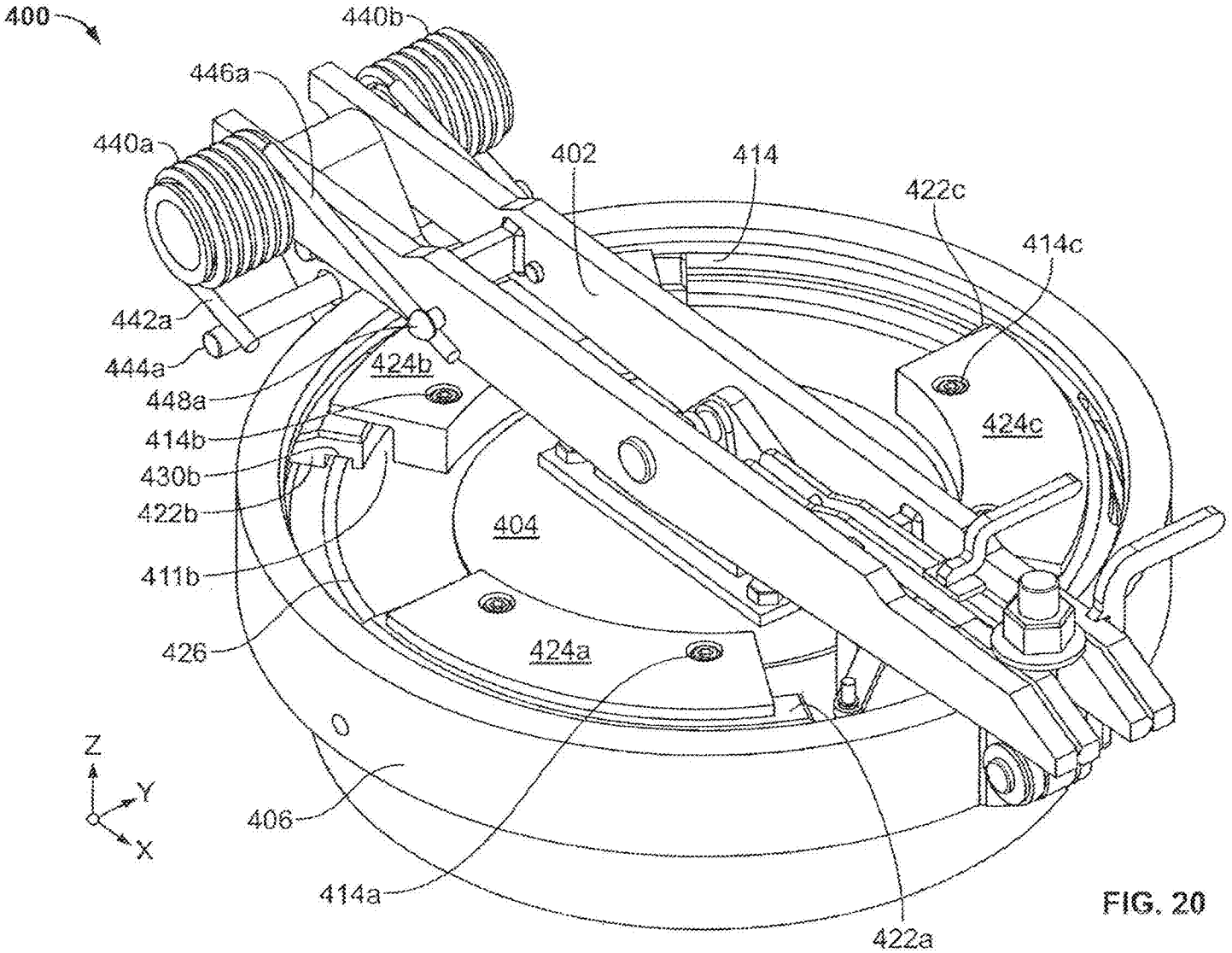
FIG. 20 is a front perspective view of a third embodiment of the manway assembly of the present technology in a closed configuration.
Figure 21:
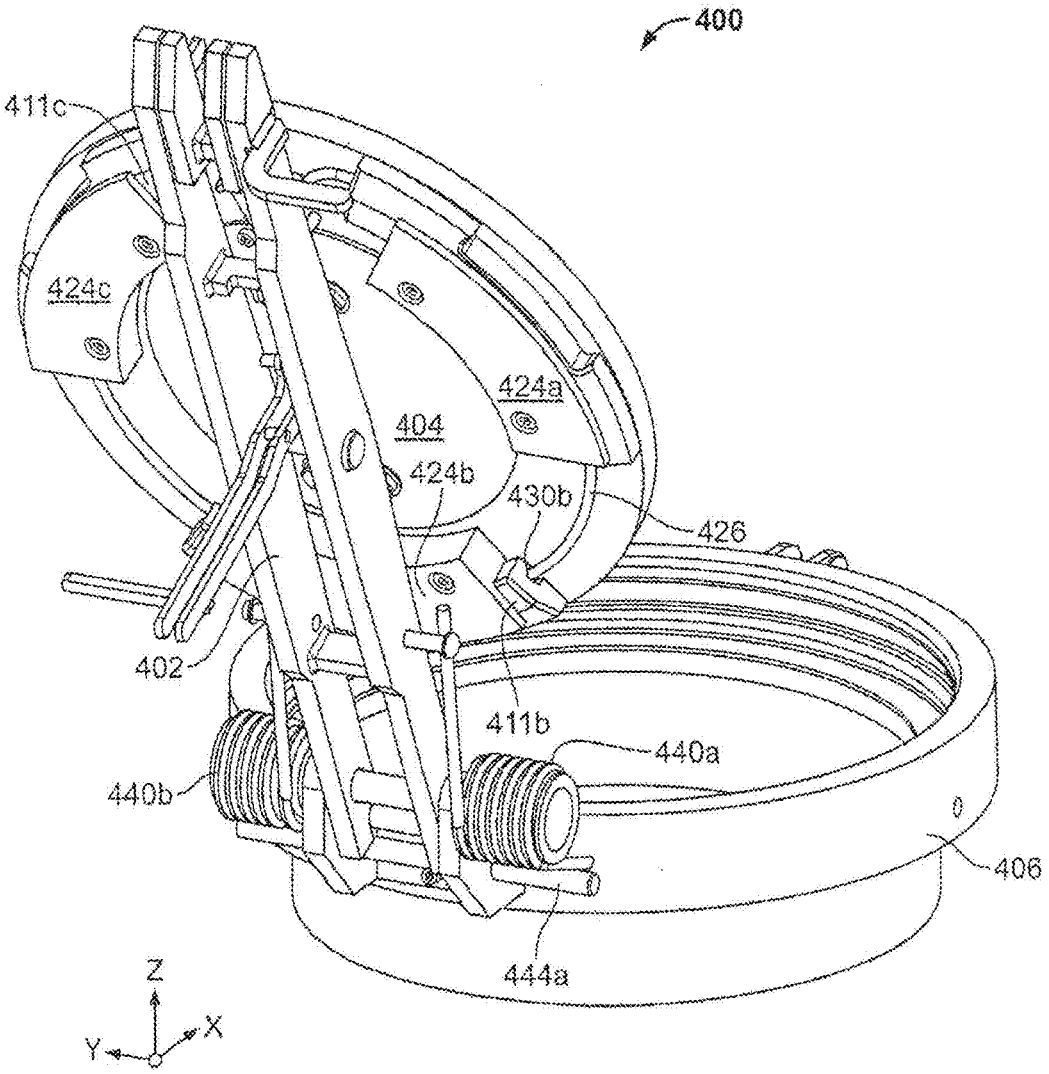
FIG. 21 is a rear perspective view of the manway assembly of FIG. 20 in an open configuration.

A third embodiment of the manway assembly of the present technology is indicated in general at 400 in FIGS. 20 and 21. As with previous embodiments, the manway assembly 400 includes a lift arm 402 mounted on the top of cover 404, both of which are positioned on a nozzle 406 which is positioned on top of a tank car body (such as 48 in FIG. 7). The nozzle defines a manway for accessing the interior of the tank car body, as described above. FIG. 20 illustrates the manway cover and lift arm in a closed configuration, while FIG. 21 illustrates the manway cover and lift arm in an open configuration.

The manway assembly of FIGS. 20 and 21 features a construction that is basically the same as the embodiment of FIGS. 17-19 (including the same latching mechanism) except that the embodiment of FIGS. 20 and 21 includes latch segments that take the form of wedge segments 422*a*-422*c* (the latch segments may take other forms, including those without a wedge surface) that are held in place by retainers 424*a*-424*c* (instead of the slots 332*a*-332*e* and retainer bolts 334*a*-334*e* of FIGS. 17 and 19). More specifically, as illustrated in FIGS. 20 and 21, the cover is provided with three generally arc-shaped retainer blocks 424*a*-424*c*. As illustrated in FIGS. 20 and 21, each retainer includes a channel formed along the underside of the outer edge (illustrated at 411*b* for retainer 424*b* and at 411*c* for retainer 424*c*, not visible for retainer 424*a*). The retainers are secured to the top surface of the cover 404 by fasteners 414*a*, 414*b* and 414*c*, which are preferably socket head cap screws. The channels (such as 411*b* and 411*c* of FIGS. 20 and 21) of the retainers are sized to secure the wedge segments 422*a*-422*c* to the cover lid, yet permit movement of the wedge segments parallel to the cover top surface, and radially with respect to the center of the cover, for engagement with a circumferential groove 414 of the nozzle 406.

As with the embodiment of FIGS. 17-19, wedge segments 422*a*-422*c* of the embodiment of FIGS. 20 and 21 are connected together by a wire spring form 426. The wire spring form 326 is constructed in such a matter to urge the wedge segments radially outward with respect to the center cover and into the positions illustrated in FIG. 20. The assembled wedge segments and wire spring form rest on the top surface of the cover 404. Wedge segments 422*a*-422*c* feature arcuate channels (illustrated at 430*b* for wedge segment 422*b* in FIGS. 20 and 21) formed along their undersides that receive the wire spring form.

It should be noted that while three wedge segments are illustrated in FIGS. 20 and 21 an alternative numbers of the wedge segments may be used.

As illustrated in FIGS. 20 and 21, the manway assembly may include lift assist springs 440*a* and 440*b*. Lift assist spring 440*a* features a first leg portion 442*a* that engages a rod 444*a* attached to the hinge lugs of the nozzle 406. A second leg portion 406*a* of the lift assist spring 440*a* engages pin 448*a* positioned on the lift arm 402. Lift assist spring 440*b* features a similar construction and attachment to the nozzle and lift arm. Each lift assist spring 440*a* and 440*b* urges the cover 404 towards the open position illustrated in FIG. 21 so as to assist a user lifting the cover via the lift arm 402. The first and second embodiment of the manway assembly described above may be equipped with a similar lift assist hinge.

Figure 22A:
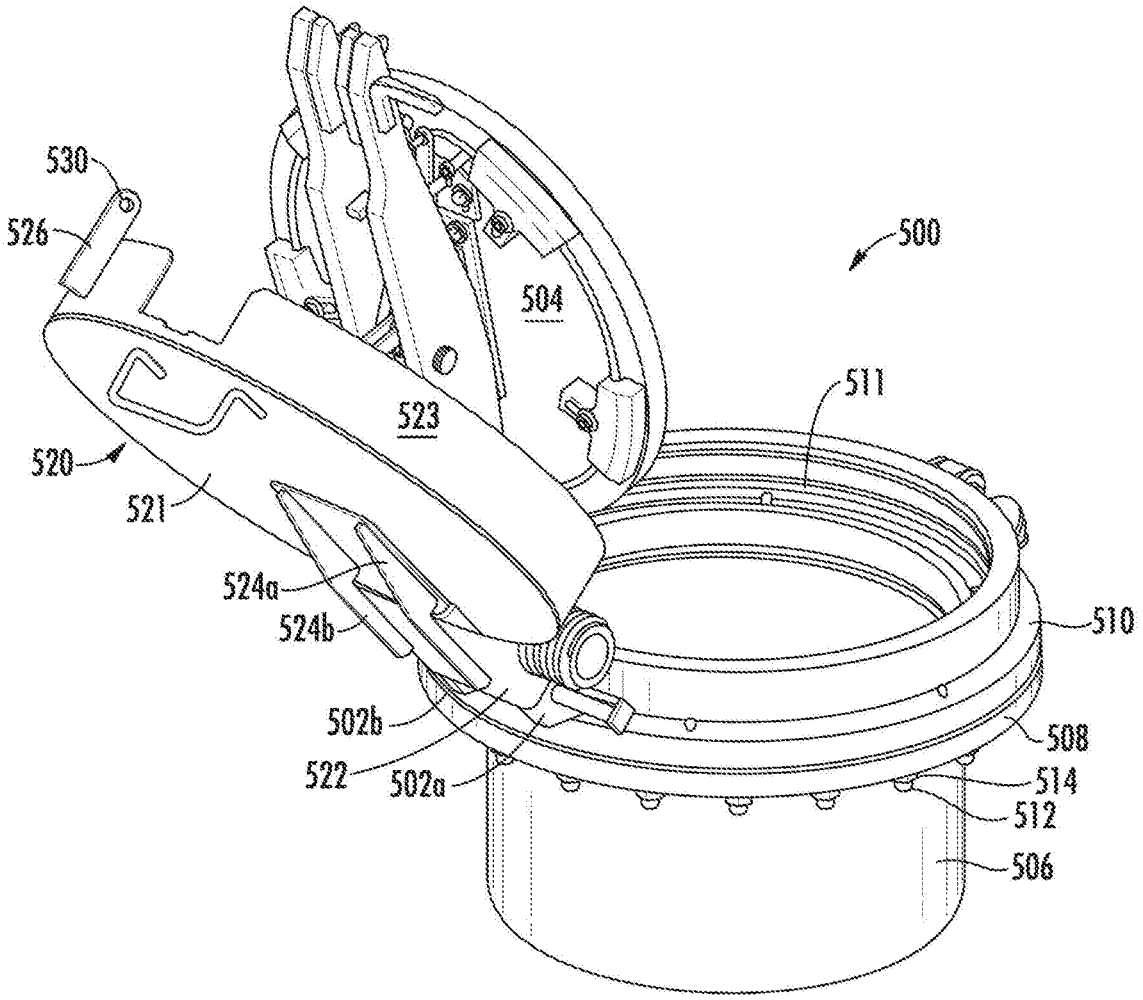
FIG. 22A is a rear perspective view of a fourth embodiment of the manway assembly of the present invention in an open configuration.
Figure 22B:
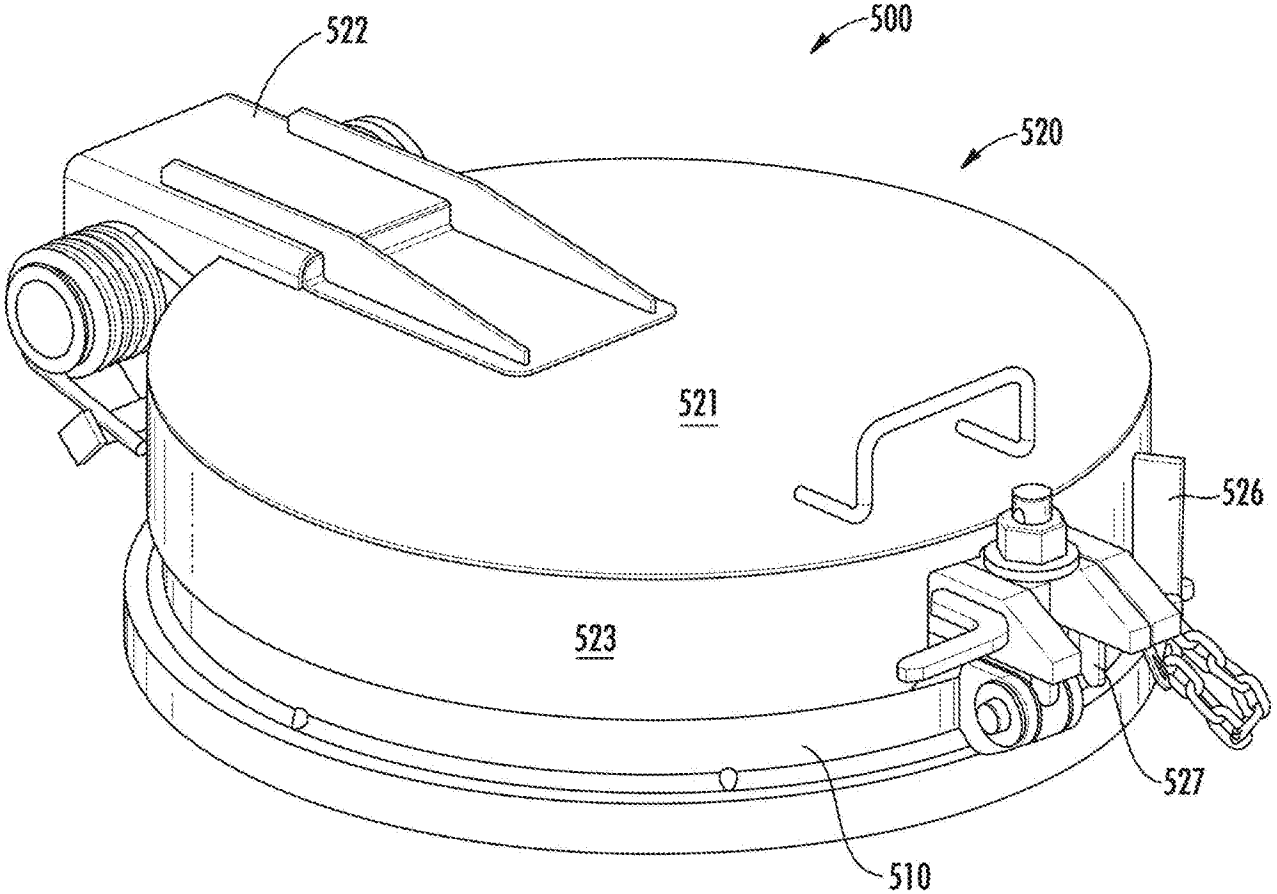
FIG. 22B is a front perspective view of a the manway assembly of FIG. 22A in a closed configuration.

A fourth embodiment of the manway assembly of the present invention is indicated in general at 500 in FIGS. 22A and 22B. As with previous embodiments, the manway assembly 500 includes a lift arm that features lift rails 502*a* and 502*b* on the top of cover 504, both of which are positioned on a nozzle 506 which is positioned on top of a tank car body (such as 48 in FIG. 7). The nozzle defines a manway for accessing the interior of the tank car body, as described above. In the embodiment of FIGS. 22A and 22B, the nozzle 506 has been provided with an annular flange 508. A nozzle rim 510 has been formed separately from the nozzle 506 and features a circumferential groove 511 that is engaged by the wedge segments of the cover assembly as described for the above embodiments. The manway assembly components, such as the lift arm, cover and latching mechanism, are attached to the nozzle rim 510, as shown in FIG. 22A. The nozzle rim 510 also features downwardly extending threaded studs 512 which pass through corresponding openings formed in the annular flange 508. Each threaded stud 512 is provided with a nut 514. As a result, the manway assembly may be more easily retrofitted to earlier production tank cars and the entire manway assembly may be removed from the tank car for replacement or repair.

The manway assembly 500 of FIGS. 22A and 22B features a construction that is basically the same as the embodiment of FIGS. 17-19 (including the same latching mechanism) except that the embodiment of FIGS. 22A and 22B also includes a pivoting outer cover, indicated in general at 520 (shown in the open position in FIG. 22A and the closed position in FIG. 22B). The outer cover features a generally round plate portion 521 and a generally continuous, circumferential wall 523 that is sized to receive the top portion of the nozzle rim 510 when in the closed position (described below).

The outer cover 520 is pivotally mounted to the hinge of the nozzle assembly by an outer cover bracket 522 which pivotally receives the pins that secure the proximal portion of the lift arm rails 502*a* and 502*b* to the hinge lugs of the nozzle assembly. The outer cover bracket is secured to the outer cover plate portion 521 by outer cover braces 524*a* and 524*b*. As a result, the outer cover bracket 522, outer cover braces 524*a* and 524*b* and the outer cover 520 pivot as a single unit about the same axis as the cover 504 between an open position (shown in FIG. 22A) and a closed position (shown in FIG. 22B) that covers the manway (i.e. the central opening of nozzle rim 510), and thus the cover 504, when the cover 504 is in the closed position such as is illustrated for cover 404 in FIG. 20. As a result, when in the closed position, the outer cover 520 of FIGS. 22A and 22B protects the cover assembly, including the latching mechanism, from the weather and dirt and other undesirable environmental conditions.

The outer cover 520 also preferably includes a locking tab 526 having a lock opening 530. When the top cover is in the closed position, the locking tab 526 is positioned adjacent to a corresponding locking tab 527 secured to the nozzle ring 510 (or nozzle flange 508 or nozzle 506) and having its own lock opening. As a result, a lock may be positioned between the aligned locking lock openings of the locking tabs positioned on the outer cover and the nozzle to prevent the outer cover 520 from being opened so as to prevent tampering with the cover 504 or its latching mechanism.

Figure 23:
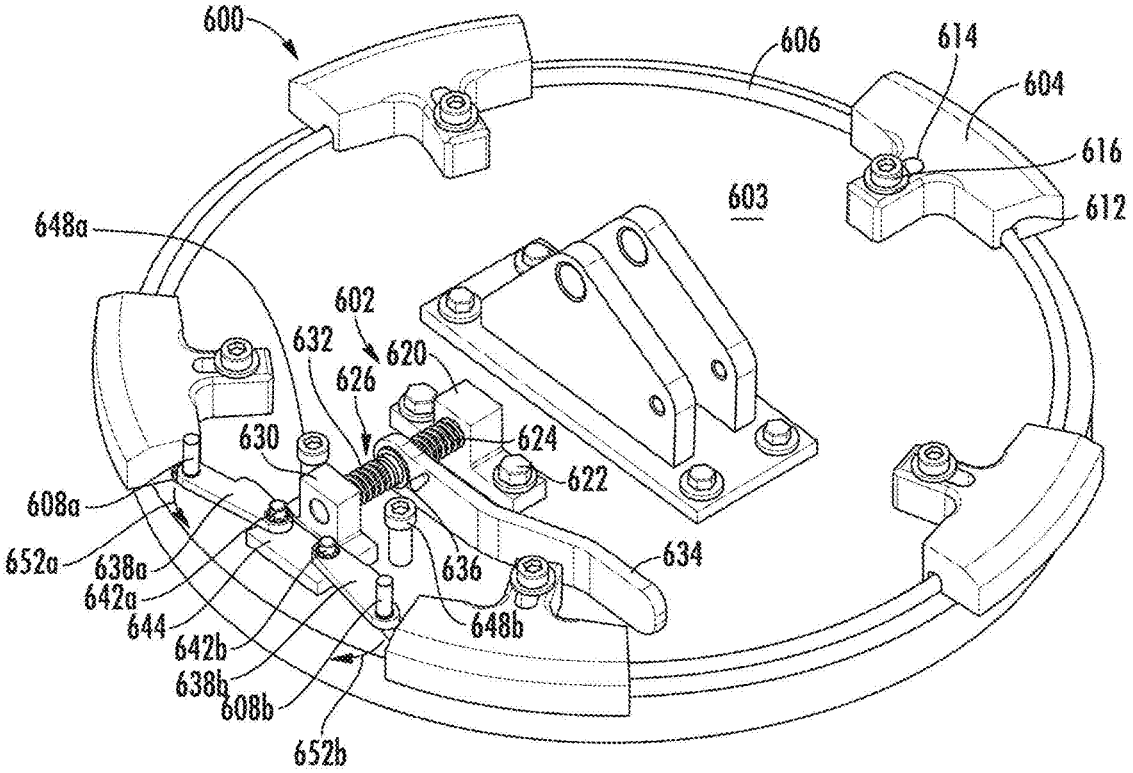
FIG. 23 is a top perspective view of the cover assembly of a fifth embodiment of the manway assembly of the present invention.

A cover assembly of a fifth embodiment of the manway assembly of the present invention is indicated in general at 600 in FIG. 23. The cover assembly 600 of FIG. 23 features the same construction and operates the same as the cover assembly of FIG. 17 with the exception of the latching mechanism, indicated in general at 602. More specifically, like the embodiment of FIG. 17, the cover 603 is provided with latch segments in the form of wedge segments 604. The wedge segments 604 are connected together by a wire spring form 606 that is formed in a generally circular shape and features upturned ends 608*a* and 608*b*. The wire spring form 606 is constructed in such a matter to urge the wedge segments 604 radially outward, and into engagement with the circumferential groove of the nozzle interior wall. As an example only, the wire spring form material may be 5/16" diameter steel wire, hard drawn ASTM A 227, finish zinc plate-baked. The wedge segments 604 of FIG. 23 feature arcuate channels 612 formed along their undersides that receive the wire spring form 606 in a sliding fashion.

Each wedge segment includes an elongated slot 614 and retainer bolts 616 pass through each slot and into bores formed through the top surface of the cover 603 so that the wedge segments are secured to the top surface of the cover. The slots 614 and retainer bolts 616 are sized so that the wedges may be moved between a locked position (illustrated in FIG. 23), where the wedge surfaces of the wedge segments 604 engage the circumferential groove of the interior surface of the nozzle, and an unlocked position, where the wedge segments are disengaged from the nozzle circumferential groove. It should be noted that while five wedge segments are illustrated in FIG. 23, alternative numbers of the wedge segments may be used instead.

The latching mechanism 602 of FIG. 23 features a holding block 620 that is secured to the cover 603 by bolts 622. The holding block includes a threaded opening that receives a first threaded portion 624 of a screw rod, indicated in general at 626. A retraction block 630 rests on the top surface of the cover 603, but is not secured thereto so that it is able to slide along the top surface. The retraction block 630 features a threaded opening that receives a second threaded portion 632 of the screw rod. The first threaded portion 624 of the screw rod features a handedness that is the opposite of the handedness of the second threaded portion 632 of the screw rod such that when the central portion of the screw rod is turned in a first direction, the retraction block 630 is pulled towards the holding block, and when the central portion of the screw rod is turned in a second direction, the retraction block 630 is pushed away from the holding block. A lever 634 is attached to the central portion of the screw rod 626, preferably via a ratcheting mechanism 636.

A pair of toggles 638*a* and 638*b* join the upturned ends 608*a* and 608*b* of the wire 606 to upwardly extending pins 642*a* and 642*b* attached to or formed on the top surface of the base 644 of the retraction block. The toggles 638*a* and 638*b* are free to pivot with respect to both the upturned ends 608*a* and 608*b* and the pins 642*a* and 642*b*.

The movement of the retraction block 630 towards the holding block 620, when the lever 634 is actuated in the first direction, causes the retraction block pins 642*a* and 642*b*, and thus the proximal ends of toggles 638*a* and 638*b*, to move towards the center of the cover (and parallel with the top surface of the cover).

A pair of fulcrum pins 648*a* and 648*b* are positioned on the cover 603. As the toggles 638*a* and 638*b* travel further towards the center of the cover, they encounter the fulcrum pins 648*a* and 648*b* which causes the toggles to further pivot in the directions indicated by arrows 652*a* and 652*b* about pins 642*a* and 642*b*. This drives the upturned ends 608*a* and 608*b* of the spring form 606 closer together which causes the wedge segments 604 to move radially inward (towards the center of the cover) so that their wedge surfaces disengage from the circumferential groove of the nozzle and the cover 603 may be opened.

Figure 24:
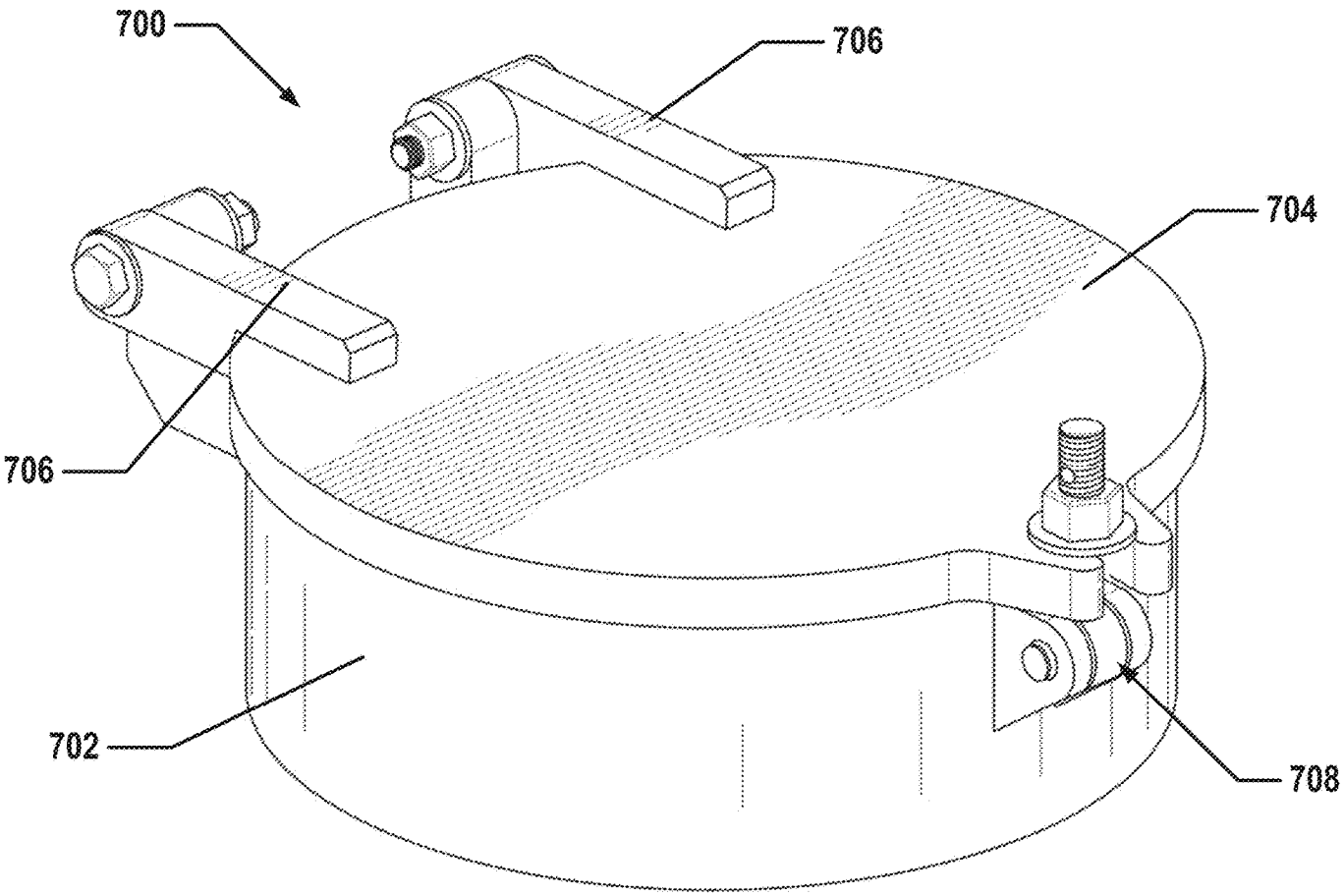
FIG. 24 is a top perspective view of a manway assembly of a sixth embodiment of the present invention in a closed configuration.
Figure 25:
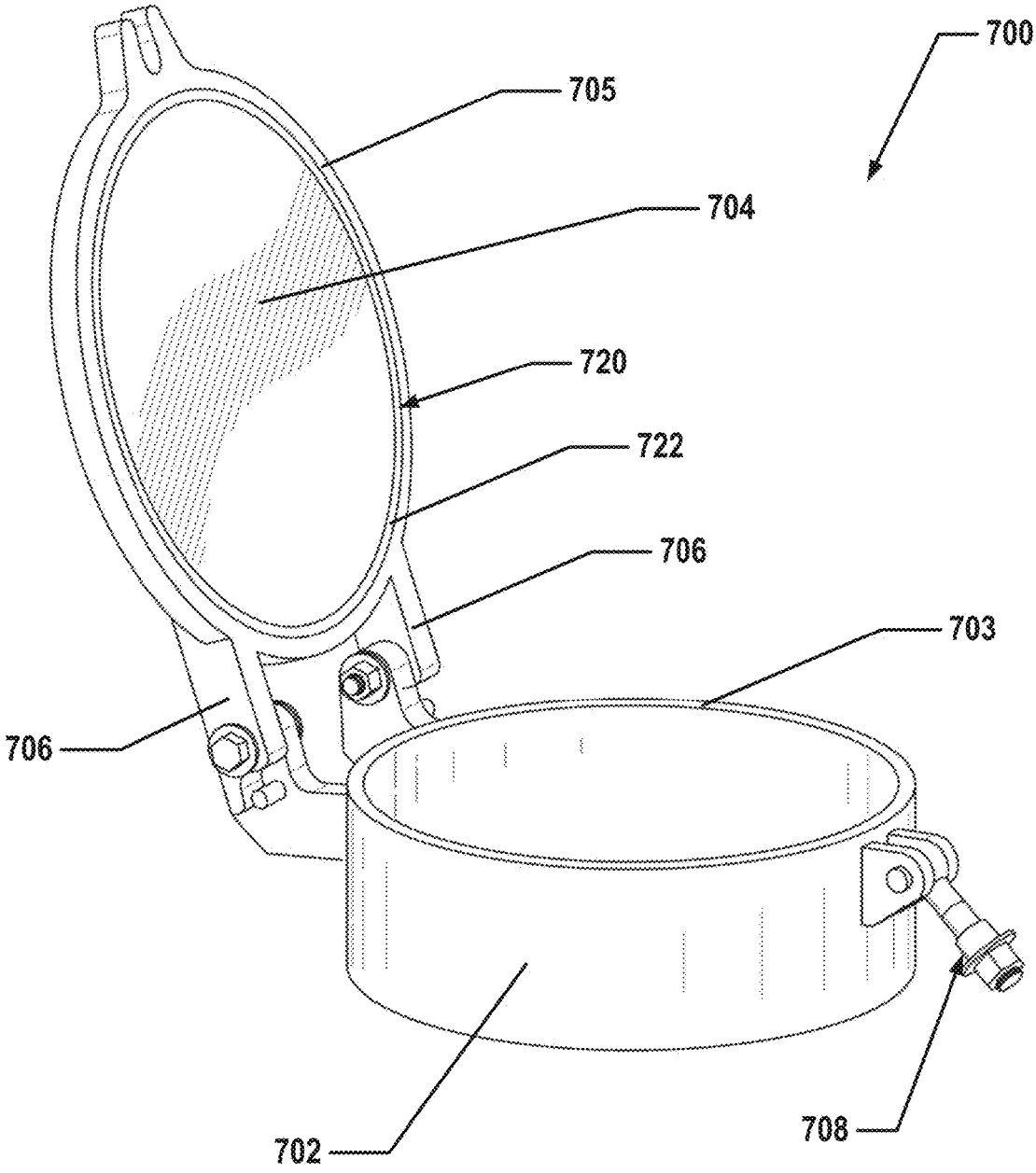
FIG. 25 is a top perspective view of the manway assembly of FIG. 24 of the present invention in an open configuration.

A sixth embodiment of the manway assembly of the present invention is indicated in general at 700 in FIGS. 24 and 25 and more specifically in FIGS. 24-28D. The manway assembly 700 of FIGS. 24 and 25 features the same construction and may operate similar to any of the manway assemblies of FIG. 7, FIG. 17, FIG. 20, FIG. 22A, or FIG. 23, with the exception of a seal assembly, indicated in general at 720. More specifically, the seal assembly 720 as described and detailed below may be utilized on any of the manway assemblies of the present invention or any other manway assemblies similar to these embodiments for use on a nozzle and manway for a railroad tank car, even prior art manway assemblies as illustrated in FIGS. 1-4.

Generally, as illustrated in FIGS. 24 and 25, the manway assembly 700 may include a nozzle 702 and a cover 704. The manway assembly 700 may also include a latching mechanism 708 and a hinge assembly 706. The hinge assembly 706 permits the cover 704 to be pivoted from a closed configuration as illustrated in FIG. 24 to an open configuration as illustrated in FIG. 25. Any latching mechanism 708 or hinge assembly 706 may be utilized with this embodiment without departing from this invention. For example, the latching mechanism 708 may be a pivoting eye bolt as illustrated in FIGS. 24 and 25. Other latching mechanisms may be utilized without departing from this invention, such as those disclosed and described above, and any other hinge assemblies such as eyebolts (swing bolts), toggle clamps, deadbolts, magnetic latches, spring latches, cam locking mechanisms, quarter turn latches, slide bolts, or wedging mechanisms. Additionally, for example, the hinge assembly 706 may be a hinge on the nozzle 702 attached to a lift arm on the cover 704 as illustrated in FIGS. 24 and 25. Other hinge assemblies may be utilized without departing from this invention, such as those disclosed and described above and any other hinge assemblies such as spring assisted hinge assemblies, pneumatic hinge assemblies, or hydraulic hinge assemblies. Lastly, the manway assembly 700 may include a seal assembly 720 to seal the cover 704 with the nozzle 702.

Figure 26:
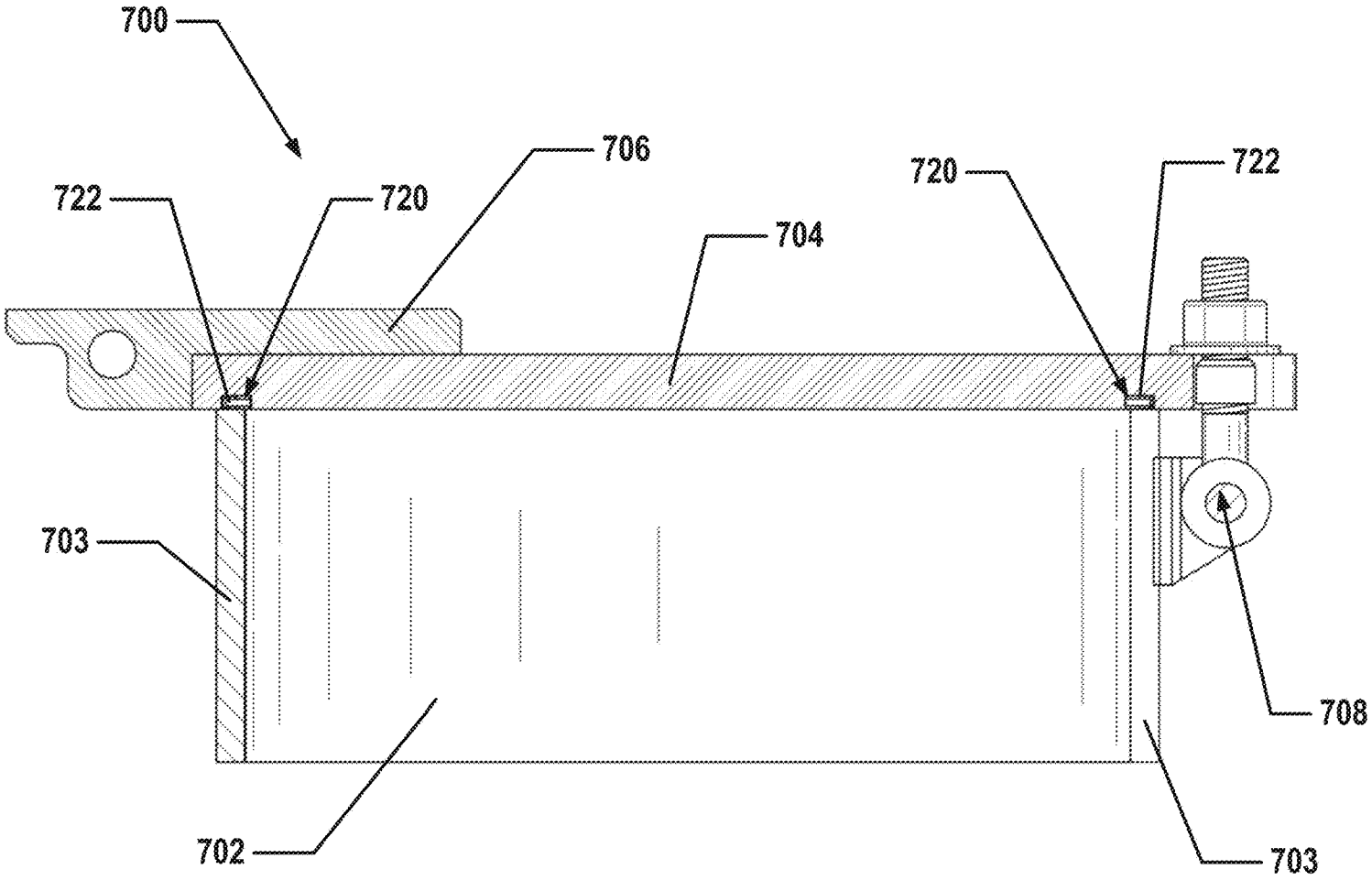
FIG. 26 is a cross sectional view of the nozzle and cover of FIG. 24 taken along vertical cutting plane of FIG. 24.
Figure 27A:
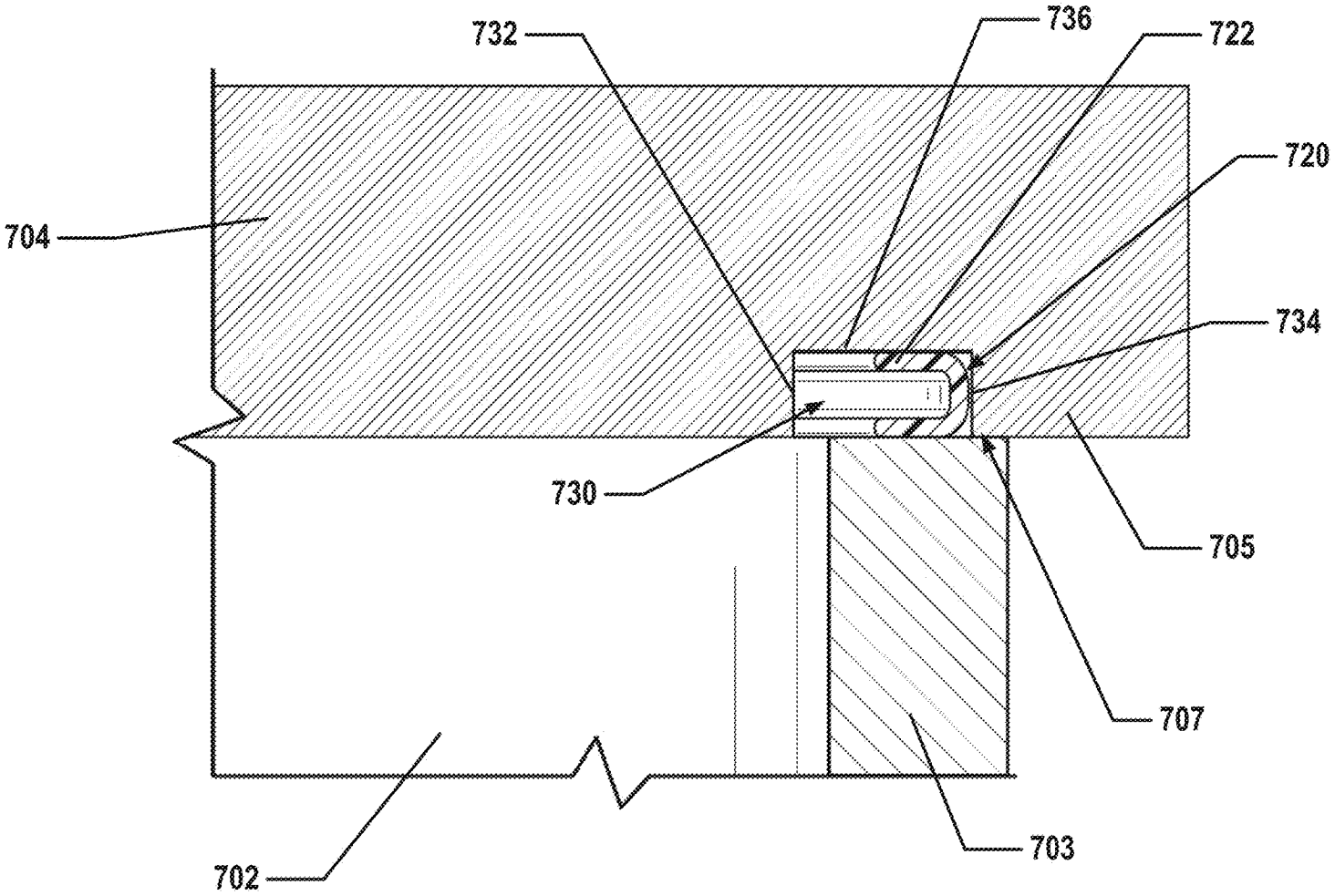
FIG. 27A is an enlarged view of portions of the nozzle and cover of FIG. 24 showing the detail of the seal between the cover and nozzle.
Figure 27B:
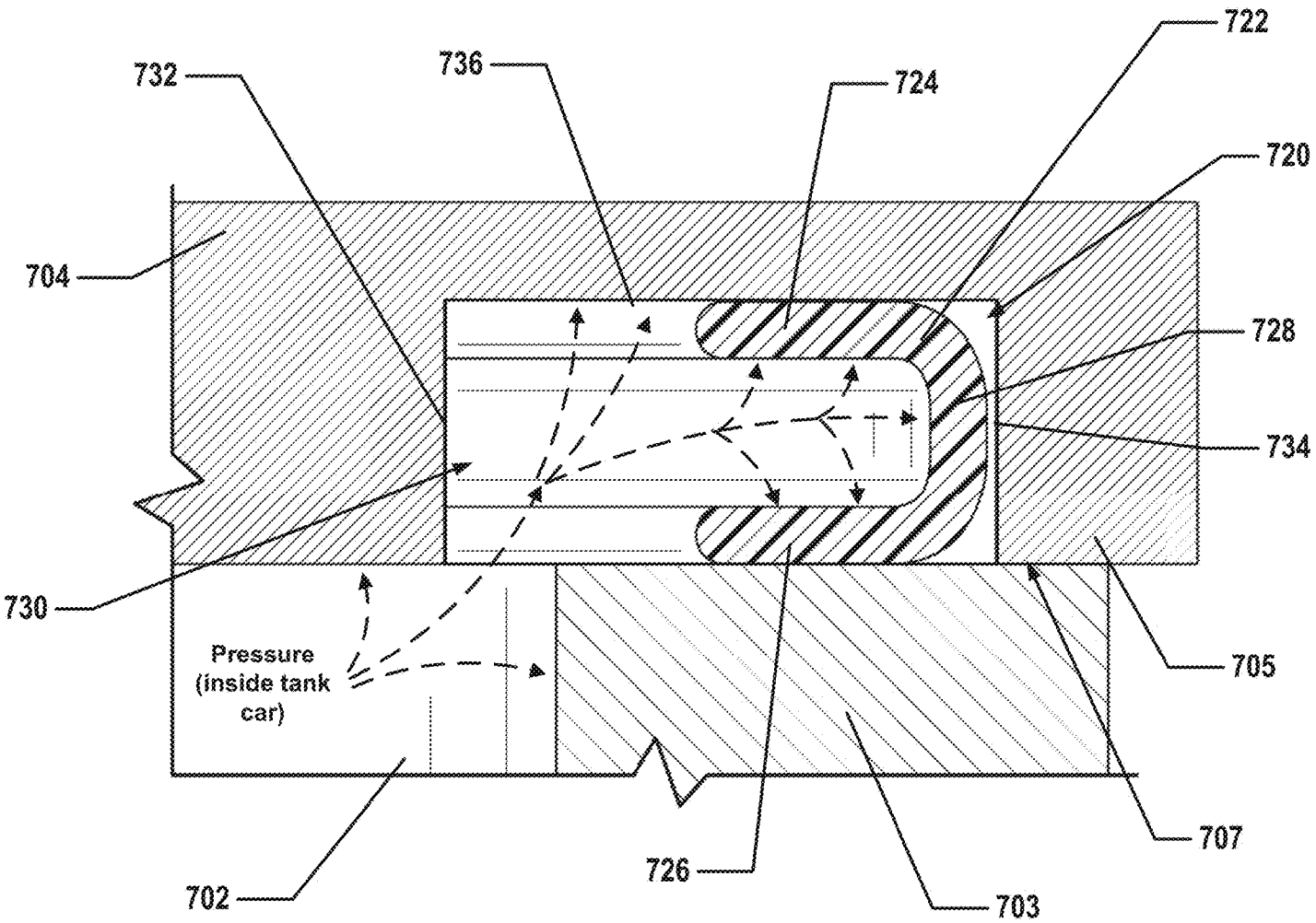
FIG. 27B is an further enlarged view of portions of the nozzle and cover of FIG. 24 showing the detail of the seal between the cover and nozzle.

The seal assembly 720 includes a seal 722 and a seal channel 730. The underside edge portion of the cover 704 is provided with a circumferential seal channel 730 and a circumferential stop portion 705. A circumferential seal 722 is positioned within the circumferential seal channel 730. As illustrated in FIGS. 26, 27A, and 27B, when the cover 704 is in the closed configuration, the circumferential seal 722 is gently compressed against a circumferential ledge 703 of the nozzle 702. As illustrated in FIGS. 26, 27A, and 27B, the circumferential stop portion 705 of the cover 704 engages the circumferential ledge 703 of the nozzle 702 to limit compression of the seal 722. Additionally, the circumferential stop portion 705 of the cover 704 provides metal to metal contact 707 with the circumferential ledge 703 of the nozzle 702 to limit the seal height.

The circumferential seal 722 as illustrated in FIGS. 26, 27A, and 27B shows a C-shaped cross-sectional shape. The circumferential seal 722 may be in the form of a lip seal as known and used in seal technologies. Further, as illustrated in FIG. 27B, the circumferential seal 722 may include a top portion 724 and a bottom portion 726 opposite the top portion 724. The top portion 724 and the bottom portion 726 may be connected by a side portion 728. Additionally, the seal channel 730 may include a front wall 732, a back wall 734 opposite the front wall 732, and a top wall 736 to create the seal channel 730. The seal channel 730 may be sized and shaped to receive the circumferential seal 722, with the top portion 724 of the seal 722 seated against the top wall 736, the side portion 728 of the circumferential seal 722 seated against the back wall 734, and the bottom portion 726 of the circumferential seal 722 seated against the circumferential ledge 703 of the nozzle 702.

The sealing assembly 720 with the circumferential seal 722 shape and seal channel 730 configuration provides benefits over prior art sealing as illustrated in FIG. 27B. As illustrated in FIG. 27B, an internal pressure of the tank car provides a sealing with the nozzle 702 and the cover 704. The circumferential seal 722 positioned in the seal channel 730 works together with the internal pressure of the tank car, wherein the internal pressure of the tank car presses against with top portion 724 of the circumferential seal 722 pressing against the top wall 736 to seal that area, the side portion 728 of the circumferential seal 722 pressing against the back wall 734 to seal that area, and the bottom portion 726 of the circumferential seal 722 pressing against the circumferential ledge 703 of the nozzle 702 to seal that area.

The circumferential seal 722 may be made of various materials known and used in the art without departing from this invention. For example, the circumferential seal 722 may be made of polytetrafluoroethylene (PTFE), filled PTFE, silicone, nitrile fluoroelastomer (FKM), perfluoroeleastomer (FFKM), polyurethane, or ethylene propylene diene monomer rubber (EPDM). The circumferential seal 722 may be also include a plastic/polymer seal portion of the seal that could be spring energized by a coupling with a metal spring.

Figure 28A:
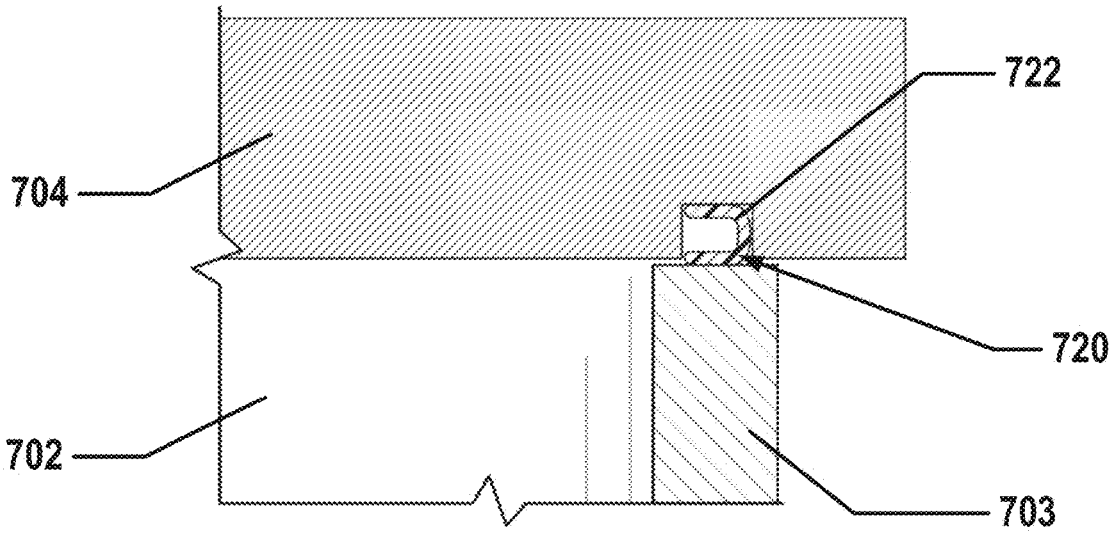
FIG. 28A is a cross sectional view of the nozzle, cover, and sealing assembly of FIG. 24 in a horizontal orientation or 0 degrees.
Figure 28B:
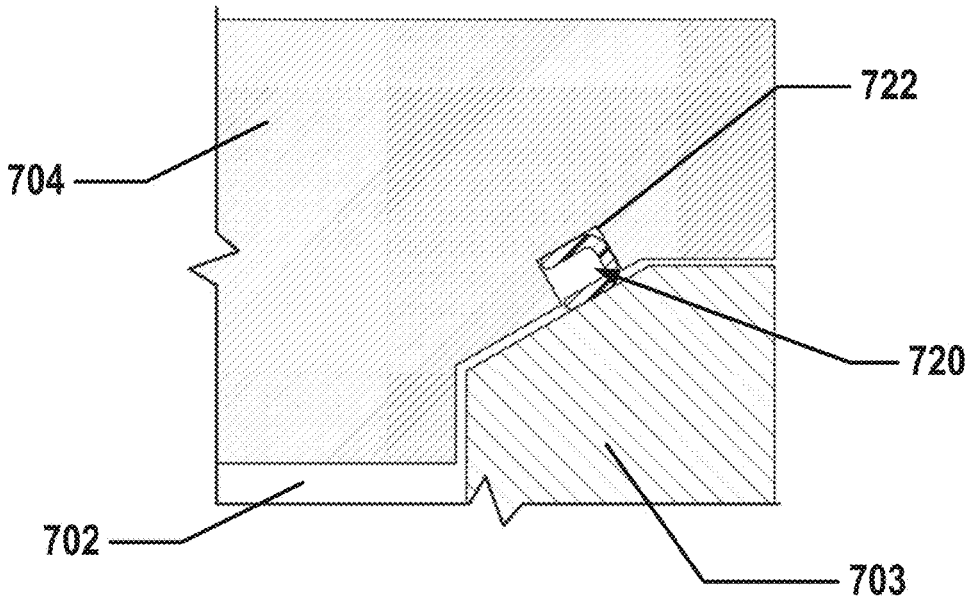
FIG. 28B is a cross sectional view of the nozzle, cover, and sealing assembly of FIG. 24 in an angled orientation of 30 degrees.
Figure 28C:
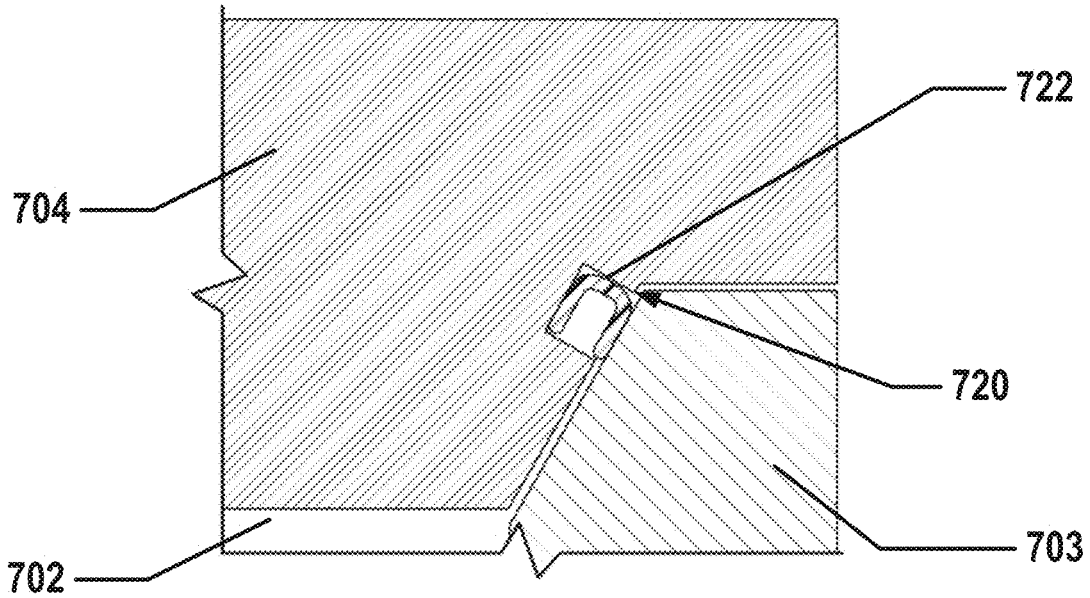
FIG. 28C is a cross sectional view of the nozzle, cover, and sealing assembly of FIG. 24 in an angled orientation of 60 degrees.
Figure 28D:
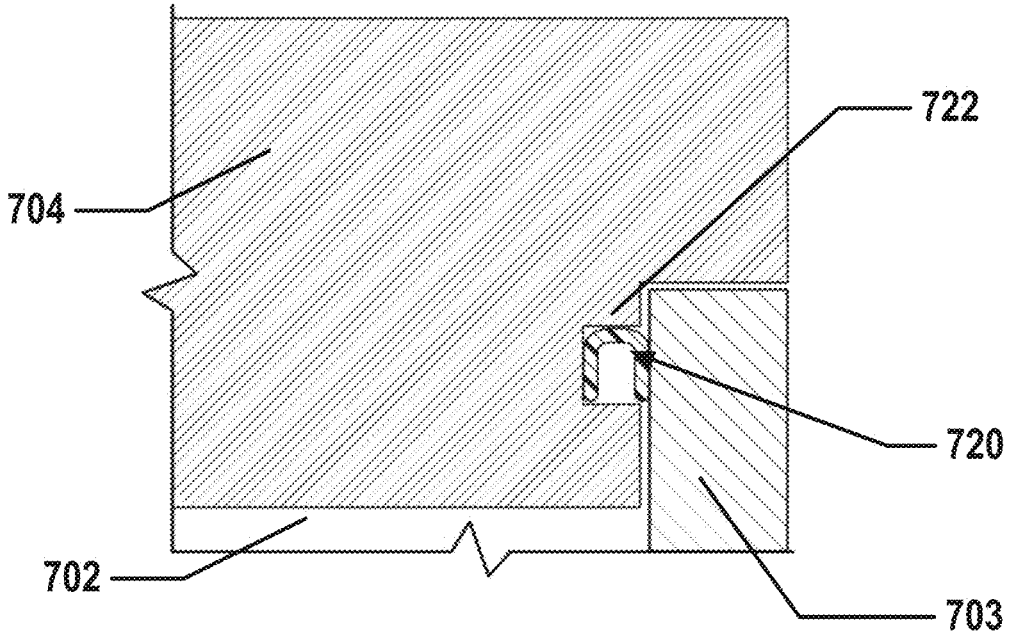
FIG. 28D is a cross sectional view of the nozzle, cover, and sealing assembly of FIG. 24 in a vertical orientation or 90 degrees.

As illustrated in FIGS. 26, 27A, and 27B, the circumferential seal 722 and the seal channel 730 are oriented in a horizontal direction with respect to the cover 704 and the nozzle 702. FIGS. 28A through 28D illustrate various other orientations of the circumferential seal 722 and the seal channel 730. FIG. 28A illustrates the horizontal direction or 0 degrees with respect to the cover 704 and the nozzle 702. FIG. 28B illustrates an angled orientation or 30 degrees with respect to the cover 704 and the nozzle 702. FIG. 28C illustrates another angled orientation or 60 degrees with respect to the cover 704 and nozzle 702. FIG. 28D illustrates a vertical direction or orientation or 90 degrees with respect to the cover 704 and the nozzle 702. As shown in FIGS. 28A-28D, the cover 704 and the nozzle 702 may be oriented in various directions and the circumferential seal 722 and the seal channel 730 may be orientated to match the cover 704 and the nozzle 702 orientation to seal the manway assembly 700.

While the preferred embodiments of the invention have been shown and described, it will be apparent to those skilled in the art that changes and modifications may be made therein without departing from the spirit of the invention, the scope of which is defined by the appended claims.

What is claimed is:

1. A manway assembly for a railroad tank car, the manway assembly comprising:

a nozzle defining an opening;

a cover;

a hinge attaching the cover to the nozzle so that said cover is pivoted between an open position, where the opening is generally uncovered, and a closed position, where the opening is generally covered by the cover; and a seal assembly to seal the cover with the nozzle, the seal assembly including a circumferential seal and a circumferential seal channel, the circumferential seal including a top portion, a bottom portion opposite the top portion, and a side portion between the top portion and the bottom portion, wherein an edge portion of the cover is provided with the circumferential seal channel and the circumferential seal is positioned within the circumferential seal channel, wherein the circumferential seal is positioned in the circumferential seal channel such that a first portion of the seal is seated against a first surface of the circumferential seal channel, and a second portion of the seal opposite the first portion is seated against a second surface opposite the first surface of the circumferential seal channel.

2. The manway assembly of claim 1, wherein the circumferential seal and the circumferential seal channel are oriented horizontally with respect to the nozzle and the cover.

3. The manway assembly of claim 1, wherein the circumferential seal and the circumferential seal channel are oriented vertically with respect to the nozzle and the cover.

4. The manway assembly of claim 1, wherein the circumferential seal and the circumferential seal channel are angle oriented at any angular orientation between horizontal and vertical with respect to the nozzle and the cover.

5. The manway assembly of claim 1, wherein the nozzle includes a sidewall.

6. A manway assembly for a railroad tank car, the manway assembly comprising:

a nozzle defining a central tank opening and having a circumferential ledge on the nozzle;

a cover defining a stop portion that provides contact with the nozzle when the cover is in a closed position on the nozzle;

a hinge attaching the cover to the nozzle so that said cover is pivoted between an open position, where the central tank opening is generally uncovered, and the closed position, where the central tank opening is generally covered by the cover; and a seal assembly to seal the cover with the nozzle, the seal assembly including a circumferential seal and a circumferential seal channel, the circumferential seal including a top portion, a bottom portion opposite the top portion, and a side portion between the top portion and the bottom portion, and the circumferential seal channel including a front wall, a back wall opposite the front wall, and a top wall to form the circumferential seal channel, wherein an edge portion of the cover is provided with the circumferential seal channel and the circumferential seal is positioned within the circumferential seal channel, wherein the circumferential seal is positioned in the circumferential seal channel such that a first portion of the seal is seated against a first surface of the circumferential seal channel, and a second portion of the seal opposite the first portion of the seal is seated against a second surface opposite of the first surface of the circumferential seal channel.

7. The manway assembly of claim 6, wherein an internal pressure of the railroad tank car presses the circumferential seal against the circumferential seal channel and the nozzle.

8. The manway assembly of claim 7, wherein the internal pressure of the railroad tank car presses the first portion of the seal and the second portion of the seal against the corresponding first surface and second surface of the circumferential seal channel the nozzle.

9. The manway assembly of claim 6, wherein the circumferential seal and the circumferential seal channel are oriented horizontal with respect to the nozzle and the cover.

10. The manway assembly of claim 6, wherein the circumferential seal and the circumferential seal channel are oriented vertically with respect to the nozzle and the cover.

11. The manway assembly of claim 6, wherein the circumferential seal and the circumferential seal channel are angle oriented at any angular orientation between horizontal and vertical with respect to the nozzle and the cover.

12. The manway assembly of claim 6, wherein the nozzle includes a sidewall.

13. A manway assembly for a railroad tank car, the manway assembly comprising:

a nozzle defining a central tank opening;

a cover defining a stop portion and a circumferential seal channel, wherein the stop portion provides contact with the nozzle when the cover is in a closed position on the nozzle;

a hinge attaching the cover to the nozzle so that said cover is pivoted between an open position, where the central tank opening is generally uncovered, and the closed position, where the central tank opening is generally covered by the cover;

a latch mechanism to secure the cover to the nozzle; and a seal assembly to seal the cover with the nozzle, the seal assembly including a circumferential seal and a circumferential seal channel, the circumferential seal including a top portion, a bottom portion opposite the top portion, and a side portion between the top portion and the bottom portion, and the circumferential seal channel including a front surface, a back surface opposite the front surface, and a top surface to form the circumferential seal channel, wherein an edge portion of the cover is provided with the circumferential seal channel and the circumferential seal is positioned within the circumferential seal channel, wherein the circumferential seal is positioned in the circumferential seal channel such that a first portion of the seal is seated against a first surface of the circumferential seal channel, and a second portion of the seal opposite the first portion of the seal is seated against the nozzle, and further wherein an internal pressure of the railroad tank car presses the circumferential seal against the circumferential seal channel and the nozzle.

14. The manway assembly of claim 13, wherein the internal pressure of the railroad tank car presses the first portion of the seal against a surface of the circumferential seal channel and the second portion of the seal against the nozzle.

15. The manway assembly of claim 13, wherein the circumferential seal and the circumferential seal channel are oriented horizontal with respect to the nozzle and the cover.

16. The manway assembly of claim 13, wherein the circumferential seal and the circumferential seal channel are oriented vertically with respect to the nozzle and the cover.

17. The manway assembly of claim 13, wherein the circumferential seal and the circumferential seal channel are angle oriented at any angular orientation between horizontal and vertical with respect to the nozzle and the cover.

18. The manway assembly of claim 13, wherein the nozzle includes a sidewall.

* * * * *